US008177533B2

(12) United States Patent
Wada et al.

(10) Patent No.: US 8,177,533 B2
(45) Date of Patent: May 15, 2012

(54) SCROLL EXPANDER AND REFRIGERATION CYCLE APPARATUS

(75) Inventors: Masanobu Wada, Osaka (JP); Takashi Morimoto, Kyoto (JP); Akira Hiwata, Shiga (JP); Akira Ikeda, Shiga (JP)

(73) Assignee: Panasonic Corporation, Osaka (JP)

( * ) Notice: Subject to any disclaimer, the term of this patent is extended or adjusted under 35 U.S.C. 154(b) by 939 days.

(21) Appl. No.: 12/279,945

(22) PCT Filed: Feb. 6, 2007

(86) PCT No.: PCT/JP2007/052035

§ 371 (c)(1),
(2), (4) Date: Aug. 19, 2008

(87) PCT Pub. No.: WO2007/097188

PCT Pub. Date: Aug. 30, 2007

(65) Prior Publication Data

US 2010/0223948 A1 Sep. 9, 2010

(30) Foreign Application Priority Data

Feb. 23, 2006 (JP) ..... 2006-046542

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |

(52) U.S. Cl. ..... 418/55.2; 418/55.1

(58) Field of Classification Search ..... 418/55.1, 418/55.2

See application file for complete search history.

(56) References Cited

U.S. PATENT DOCUMENTS

| | | | | |
|---|---|---|---|---|
| 4,494,914 | A * | 1/1985 | Shiibayashi | 418/55.2 |
| 5,467,613 | A * | 11/1995 | Brasz | 62/402 |
| 5,683,237 | A | 11/1997 | Hagiwara et al. | |
| 6,736,622 | B1 * | 5/2004 | Bush et al. | 418/55.2 |

FOREIGN PATENT DOCUMENTS

| | | | |
|---|---|---|---|
| JP | 5-015945 | B2 | 3/1993 |
| JP | 7-091384 | A | 4/1995 |
| JP | 8-014171 | A | 1/1996 |
| JP | 8-028461 | A | 1/1996 |
| JP | 3170111 | B2 | 3/2001 |
| JP | 2002-364563 | A | 12/2002 |

* cited by examiner

*Primary Examiner* — Mary A Davis

(74) *Attorney, Agent, or Firm* — Hamre, Schumann, Mueller & Larson, P.C.

(57) ABSTRACT

A lap (201) of an orbiting scroll (21) and a lap (202) of a stationary scroll (22) are meshed with each other to form an inner wall side expansion chamber (203*a*) on the side of a lap inner wall (201*a*) of the orbiting scroll (21) and an outer wall side expansion chamber (203*b*) on the side of a lap outer wall (201*a*) of the orbiting scroll (21). The volumetric capacity of the inner wall side expansion chamber (203*a*) and that of the outer wall side expansion chamber (203*b*) are equal to each other when suction is completed, and different from each other when discharge starts, and their expansion ratios are different from each other.

3 Claims, 17 Drawing Sheets

SCROLL EXPANDER AND REFRIGERATION CYCLE APPARATUS

TECHNICAL FIELD

The present invention relates to a scroll expander for expanding a compressible fluid to recover mechanical power energy and a refrigeration cycle apparatus provided with the scroll expander.

BACKGROUND ART

A scroll expander includes a stationary scroll and an orbiting scroll that are meshed with each other. An end plate and a scroll lap mounted upright on the end plate are provided on each of the stationary scroll and the orbiting scroll. In the scroll expander, an expansion chamber is formed between the end plate and lap of the stationary scroll and the end plate and lap of the orbiting scroll. The orbiting scroll moves in a circular orbit while being restricted in self rotation by a rotation-restricting mechanism. When the orbiting scroll thus revolves, the expansion chamber moves while changing its volumetric capacity, thereby carrying out suction, expansion and discharge of a fluid.

The expansion chamber is formed on each of the inner wall side and the outer wall side of the lap of the orbiting scroll. The expansion ratio of the expansion chamber on the inner wall side of the lap (hereinafter referred to as an inner wall side expansion chamber) and that of the expansion chamber on the outer wall side of the lap (hereinafter referred to as an outer wall side expansion chamber) are determined respectively by the shapes of the laps of the orbiting scroll and the stationary scroll. For example, as disclosed in JP 08(1996)-28461 A and JP 2002-364563 A, in a conventional scroll expander, both laps provided on a stationary scroll and an orbiting scroll are formed in such shapes that the expansion ratio of the inner wall side expansion chamber and that of the outer wall side expansion chamber are equal to each other.

The expansion chambers of a conventional scroll expander are described below with reference to FIG. 15. This scroll expander includes a stationary scroll having a lap 502 and an orbiting scroll having a lap 501. An inner wall side expansion chamber 503*a* is formed on the side of a lap inner wall 501*a* of the orbiting scroll, and an outer wall side expansion chamber 503*b* is formed on the side of a lap outer wall 501*b* thereof.

In the case of a refrigeration cycle apparatus provided with this scroll expander, a fluid to be expanded is a refrigerant. The refrigerant is drawn through a suction port 507 provided in the center of the scrolls. The drawn-in refrigerant expands and moves toward the outer peripheral portions of the respective scrolls along with a change in the volumetric capacities of the expansion chambers 503*a* and 503*b*, and is discharged from a discharge port 506.

FIG. 15 illustrates the moment when the radially innermost expansion chambers 503*a* and 503*b* shift from the suction process to the expansion process. In other words, FIG. 15 shows the moment when, in the center of the scrolls, the lap inner wall 501*a* of the orbiting scroll and the lap outer wall 502*b* of the stationary scroll come in contact with each other, and the lap outer wall 501*b* of the orbiting scroll and the lap inner wall 502*a* of the stationary scroll come in contact with each other, that is, the moment when contact surfaces 504 and 505 are created. As is apparent from FIG. 15, the inner wall side expansion chamber 503*a* and the outer wall side expansion chamber 503*b* are closed at the same time.

As the expansion process proceeds, the contact surfaces 504 and 505 move toward the outer circumference of the scrolls following the shapes of the laps, and eventually disappear at the same time in the outermost peripheral portion of the scrolls. That is, the inner wall side expansion chamber 503*a* and the outer wall side expansion chamber 503*b* are opened at the same time. In this scroll expander, the involute lap on the lap inner wall 502*a* of the stationary scroll is terminated at a midway position 502*c*, so that a position where the contact surface 504 between the lap inner wall 501*a* of the orbiting scroll and the lap outer wall 502*b* of the stationary scroll disappears is displaced by 180 degrees from a position where the contact surface 505 between the lap outer wall 501*b* of the orbiting scroll and the lap inner wall 502*a* of the stationary scroll disappears. Thereby, the inner wall side expansion chamber 503*a* and the outer wall side expansion chamber 503*b* are opened at the same time.

As described above, in the conventional scroll expander, the inner wall side expansion chamber 503*a* and the outer wall side expansion chamber 503*b* start closing at the same time and start opening at the same time, that is, the expansion processes in the respective expansion chambers 503*a* and 503*b* start at the same time and finish at the same time. As a result, the expansion ratios of these two chambers 503*a* and 503*b* are equal to each other.

However, since the expansion ratios of both the expansion chambers 503*a* and 503*b* of the above-mentioned scroll expander are fixed all the time, it cannot necessarily perform an efficient expansion operation constantly in such an application as a refrigeration cycle apparatus in which the preferred expansion ratio varies according to the operation conditions.

To be more specific, when a scroll expander is used for a refrigeration cycle apparatus, for example, the high pressure and the low pressure of the refrigeration cycle vary as the operation conditions of the refrigeration cycle apparatus change. The suction pressure and the discharge pressure of the expander also vary accordingly. However, since the expansion ratios of the expansion chambers are preset to a fixed design ratio, as described above, over-expansion or under-expansion of a refrigerant may occur in the expander depending on the values of the suction pressure and the discharge pressure.

FIGS. 16A to 16C show pressure-volume diagrams in an expansion process. FIG. 16A shows a case where the expansion ratio of an expansion chamber coincides with the high pressure/low pressure condition of a refrigeration cycle apparatus. In other words, it shows a case where the expansion ratio of the expansion chamber is equal to the pressure ratio between the high pressure and the low pressure of the refrigeration cycle apparatus. In this case, no loss occurs in the expansion process.

On the other hand, FIG. 16B shows a case of an operation condition where the high pressure is higher and the low pressure is lower respectively than the high pressure/low pressure condition of the refrigeration cycle apparatus of FIG. 16A (Ph2>Ph1 and Pl2<Pl1). This operation condition occurs in a case where heat is radiated when a temperature outside a radiator is higher and heat is received when a temperature outside an evaporator is lower respectively than the temperatures of the operation condition of FIG. 16A. The suction volume and the discharge volume of the expansion chamber are designed so that the refrigerant expands just enough under the high pressure/low pressure condition of Ph1/Pl1. Therefore, assuming that the pressure Ph2 of the refrigerant to be drawn into the expansion chamber is greater than Ph1, the refrigerant to be discharged from the expansion chamber cannot expand to reach the low pressure Pl2 of the refrigeration cycle apparatus, thereby being discharged at a higher pressure than Pl2. As a result, under-expansion occurs under the operation condition of FIG. 16B, thereby causing a loss as shown in a diagonally shaded area in FIG. 16B.

FIG. 16C shows a case of an operation condition where the high pressure is lower and the low pressure is higher respectively than the high pressure/low pressure condition of the refrigeration cycle apparatus of FIG. 16A (Ph3<Ph1 and Pl3>Pl1). This operation condition occurs in such a case where heat is radiated when a temperature outside a radiator is lower and heat is received when a temperature outside an evaporator is higher than the temperatures of the operation condition of FIG. 16A. As described above, the suction volume and the discharge volume of the expansion chamber are designed so that the refrigerant expands just enough under the high pressure/low pressure condition of Ph1/Pl1. Therefore, assuming that the pressure Ph3 of the refrigerant to be drawn into the expansion chamber is smaller than Ph1, the refrigerant to be discharged from the expansion chamber expands to exceed the low pressure Pl3 of the refrigeration cycle apparatus, thereby being discharged at a lower pressure than Pl3. As a result, over-expansion occurs under the operation condition of FIG. 16C, thereby causing a loss as shown in a diagonally shaded area in FIG. 16C.

As described above, a refrigeration cycle apparatus or the like including a conventional scroll expander can perform a highly efficient operation as long as the high pressure/low pressure of the refrigeration cycle apparatus coincides with the design expansion ratio of the scroll expander. However, on the other hand, even a small change in operation conditions easily increases a loss caused by under-expansion or over-expansion. Therefore, the expander deteriorates in mechanical power recovery performance, which results in difficulty in sufficiently enhancing the capability of the refrigeration cycle apparatus.

DISCLOSURE OF INVENTION

The present invention has been conceived to solve this problem, and it is an object of the present invention to suppress a deterioration in mechanical power recovery performance of a scroll expander caused by a change in operation conditions. It is another object of the present invention to provide a refrigeration cycle apparatus capable of functioning efficiently over a wide range of operations using such a scroll expander.

The present invention provides a scroll expander including: a first scroll having a first scroll lap; and a second scroll having a second scroll lap that is meshed with the first scroll lap. In this scroll expander, the first scroll and the second scroll form an inner wall side expansion chamber on the inner wall side of the first scroll lap and an outer wall side expansion chamber on the outer wall side of the first scroll lap. The inner wall side expansion chamber and the outer wall side expansion chamber move from the center toward the outer circumference of the scrolls while increasing their volumetric capacities along with a revolution of the first scroll relative to the second scroll. The first scroll lap and the second scroll lap have such shapes that an expansion ratio of the inner wall side expansion chamber and an expansion ratio of the outer wall side expansion chamber are different from each other.

Thereby, even if operation conditions are changed, there is no possibility that over-expansion or under-expansion occurs in both the expansion chambers (the inner wall side expansion chamber and the outer wall side expansion chamber) at the same time. Since the expansion ratios of these two expansion chambers are different from each other, if over-expansion occurs in one of the expansion chambers, over-expansion is suppressed in the other expansion chamber. Likewise, if under-expansion occurs in one of the expansion chambers, under-expansion is suppressed in the other expansion chamber. This scroll expander makes it possible to suppress a serious deterioration in mechanical power recovery performance caused by overexpansion and under-expansion, even if the operation conditions are changed.

In another aspect, the present invention provides a refrigeration cycle apparatus including: a compressor; a radiator; an expander; and an evaporator that are connected successively in series by pipes. The expander includes the scroll expander of the present invention as described above.

This refrigeration cycle apparatus makes it possible to achieve high efficiency over a wide operating range.

BEST MODE FOR CARRYING OUT THE INVENTION

Figure 1:
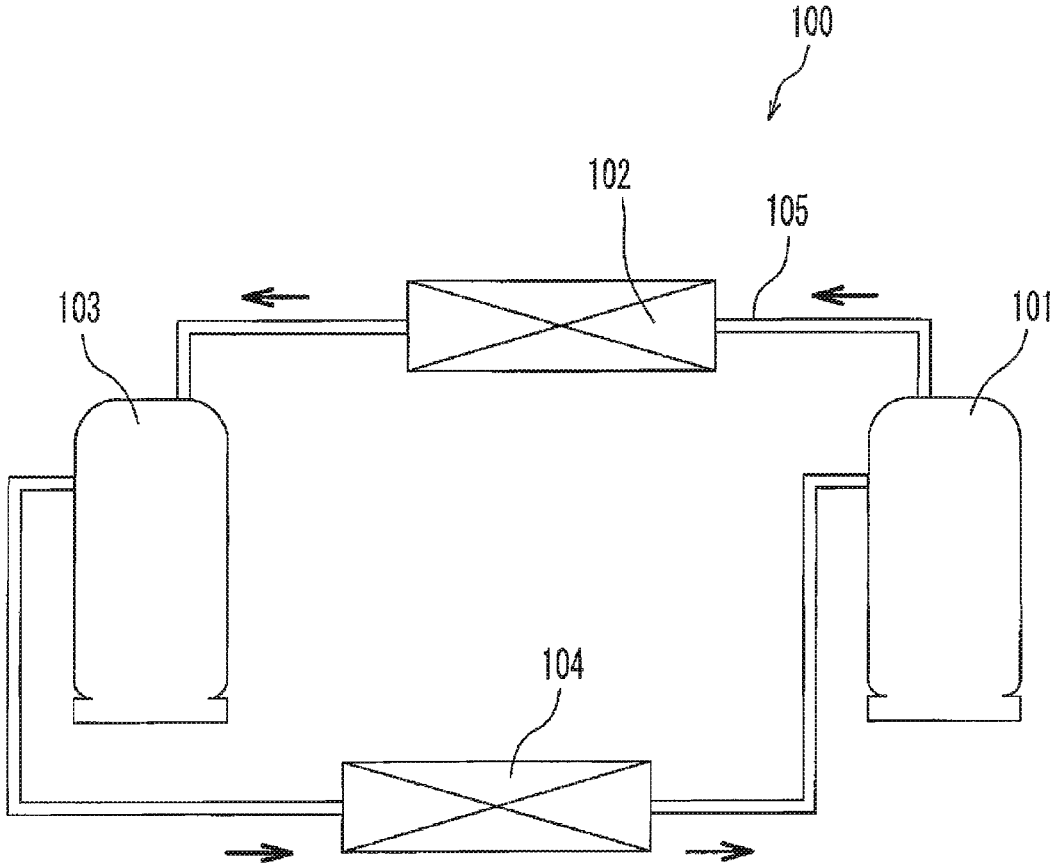
FIG. 1 is a diagram showing a configuration of a refrigeration cycle apparatus according to a first embodiment of the present invention.

The scroll expander of the present invention may be configured specifically in the following manner.

The scroll expander of the present invention may include: a suction passage that is formed in the center of the orbiting scroll or the stationary scroll and introduces a fluid into the inner wall side expansion chamber and the outer wall side expansion chamber, and a discharge passage that is formed on the outer circumference side of the orbiting scroll or the stationary scroll and discharges the fluid from the inner wall side expansion chamber and the outer wall side expansion chamber.

Furthermore, the volumetric capacity of the inner wall side expansion chamber and the volumetric capacity of the outer wall side expansion chamber may be equal to each other when suction is completed, and different from each other when discharge starts.

This configuration makes it possible to realize the expansion chambers with expansion ratios different from each other while minimizing design changes from a conventional configuration.

Along with the revolution of the first scroll relative to the second scroll, a first contact surface and a second contact surface are created at the same time in the center of the scrolls. The first contact surface is a contact surface between the inner wall of the first scroll lap and the outer wall of the second scroll lap, and the second contact surface is a contact surface between the outer wall of the first scroll lap and the inner wall of the second scroll lap. An involute step may be provided on the inner wall of the second scroll lap in such a manner that a second disappearance position may be displaced from a first disappearance position by a predetermined angle of more than 0 degree but less than 180 degrees or a predetermined angle of more than 180 degrees but less than 360 degrees toward a volute tongue side of the second scroll lap. The first disappearance position is a position where the first contact surface disappears after moving from the center toward the outer circumference of the scrolls, and the second disappearance position is a position where the second contact surface disappears after moving from the center toward the outer circumference of the scrolls.

An "involute step" means a portion where the shape of an involute curve is changed or the involute curve is terminated. In other words, an "involute step" means a portion where an outline on a cross section parallel to a rotating plane is off the involute curve. For example, if a portion of the inner wall of a scroll lap that is formed according to an involute curve with a fixed radius of a base circle is cut away, such an involute step is formed, and thereby the position where a contact surface on the inner wall side of the scroll lap (that is, a contact surface on the outer wall side of the other scroll lap) disappears is changed.

By changing the shape of the second scroll lap from the conventional one, the position where the involute lap of the second scroll lap is terminated (the position where the second contact surface disappears) can be changed. According to the scroll expander as described above, the first disappearance position and the second disappearance position are displaced from each other by a predetermined angle of more than 0 degree but less than 180 degrees or a predetermined angle of more than 180 degrees but less than 360 degrees, and the second disappearance position is in the outermost peripheral portion of the second scroll lap. Here, the outermost peripheral portion of the second scroll lap is not a portion where the first scroll lap and the second scroll lap are meshed with each other, but a thick portion of the second scroll. Therefore, even if the shape of the second scroll is changed from the conventional one in order to make the expansion ratios of the inner wall side expansion chamber and the outer wall side expansion chamber different from each other, there is no significant change in the thickness of the lap. Accordingly, this scroll expander makes it possible to maintain a lap strength comparable to the conventional strength, and thus maintain high reliability as well.

Furthermore, along with the revolution of the first scroll relative to the second scroll, a first contact surface and a second contact surface are created at the same time in the center of the scrolls. The first contact surface is a contact surface between the inner wall of the first scroll lap and the outer wall of the second scroll lap, and the second contact surface is a contact surface between the outer wall of the first scroll lap and the inner wall of the second scroll lap. An involute step may be provided on the outer wall of the first scroll lap in such a manner that a second disappearance position is displaced from a first disappearance position by a predetermined angle of more than 0 degree but less than 180 degrees or a predetermined angle of more than 180 degrees but less than 360 degrees toward a volute tongue side of the second scroll lap. The first disappearance position is a position where the first contact surface disappears after moving from the center toward the outer circumference of the scrolls, and the second disappearance position is a position where the second contact surface disappears after moving from the center toward the outer circumference of the scrolls.

The volumetric capacity of the inner wall side expansion chamber and the volumetric capacity of the outer wall side expansion chamber may be different from each other when suction is completed, and equal to each other when discharge starts.

This configuration makes it possible to realize the expansion chambers with expansion ratios different from each other while minimizing design changes from a conventional configuration.

Along with the revolution of the first scroll relative to the second scroll, a first contact surface and a second contact surface are created in the center of the scrolls. The first contact surface is a contact surface between the inner wall of the first scroll lap and the outer wall of the second scroll lap, and the second contact surface is a contact surface between the outer wall of the first scroll lap and the inner wall of the second scroll lap. An involute angle of the inner wall of the first scroll lap at a position where the first contact surface is created is greater than an involute angle of the inner wall of the second scroll lap at a position where the second contact surface is created, and the first contact surface and the second contact surface may disappear at the same time after moving from the center toward the outer circumference of the scrolls.

At a moment when the first scroll lap and the second scroll lap are apart from each other, that is, a moment when each contact surface disappears, vibrations may occur due to a pressure difference between the discharge pressure and the pressures inside the expansion chambers at the time of being opened. However, in this scroll expander, the first contact surface and the second contact surface disappear at the same time and the expansion chambers are opened at the same time. As a result, it is possible to suppress vibrations and thus suppress noise, compared with the case where the expansion chambers are opened alternately.

Along with the revolution of the first scroll relative to the second scroll, a first contact surface and a second contact surface are created in the center of the scrolls. The first contact surface is a contact surface between the inner wall of the first scroll lap and the outer wall of the second scroll lap, and the second contact surface is a contact surface between the outer wall of the first scroll lap and the inner wall of the second scroll lap. An involute angle of the inner wall of the first scroll lap at a position where the first contact surface is created is smaller than an involute angle of the inner wall of the second scroll lap at a position where the second contact surface is created, and the first contact surface and the second contact surface may disappear at the same time after moving from the center toward the outer circumference of the scrolls.

It should be noted here that an adjustment of a lap shape is a concept including an adjustment of a lap thickness.

It is possible, in the refrigeration cycle apparatus of the present invention, to make the expansion ratio of at least one of the inner wall side expansion chamber and the outer wall side expansion chamber different from a predetermined standard expansion ratio of which occurrence frequency is considered to be highest in the operation conditions of the refrigeration cycle apparatus. This refrigeration cycle apparatus can achieve high efficiency over a wide operating range, compared with the case where the expansion chambers are designed based on the standard expansion ratio of which occurrence frequency is highest in the operation conditions of the refrigeration cycle apparatus (the expansion ratios of both the expansion chambers are equal to the standard expansion ratio).

Hereinafter, embodiments of the present invention will be described with reference to the accompanying drawings. The present invention is not limited to the following embodiments.

(First Embodiment)

FIG. 1 is a diagram showing a configuration of a refrigeration cycle apparatus 100 in a first embodiment of the present invention. The refrigeration cycle apparatus 100 is configured in such a manner that a compressor 101, a radiator 102, an expander 103, and an evaporator 104 are connected successively in series by pipes 105. This refrigeration cycle apparatus 100 is an apparatus in which a refrigerant circulates in a fixed direction. However, the refrigeration cycle apparatus of the present invention may be, for example, a refrigeration cycle apparatus or the like capable of performing a reversible operation in which the circulation direction of a refrigerant is variable. The refrigeration cycle apparatus 100 can be used as a water heater, an air conditioner, or the like, for example.

Figure 2:
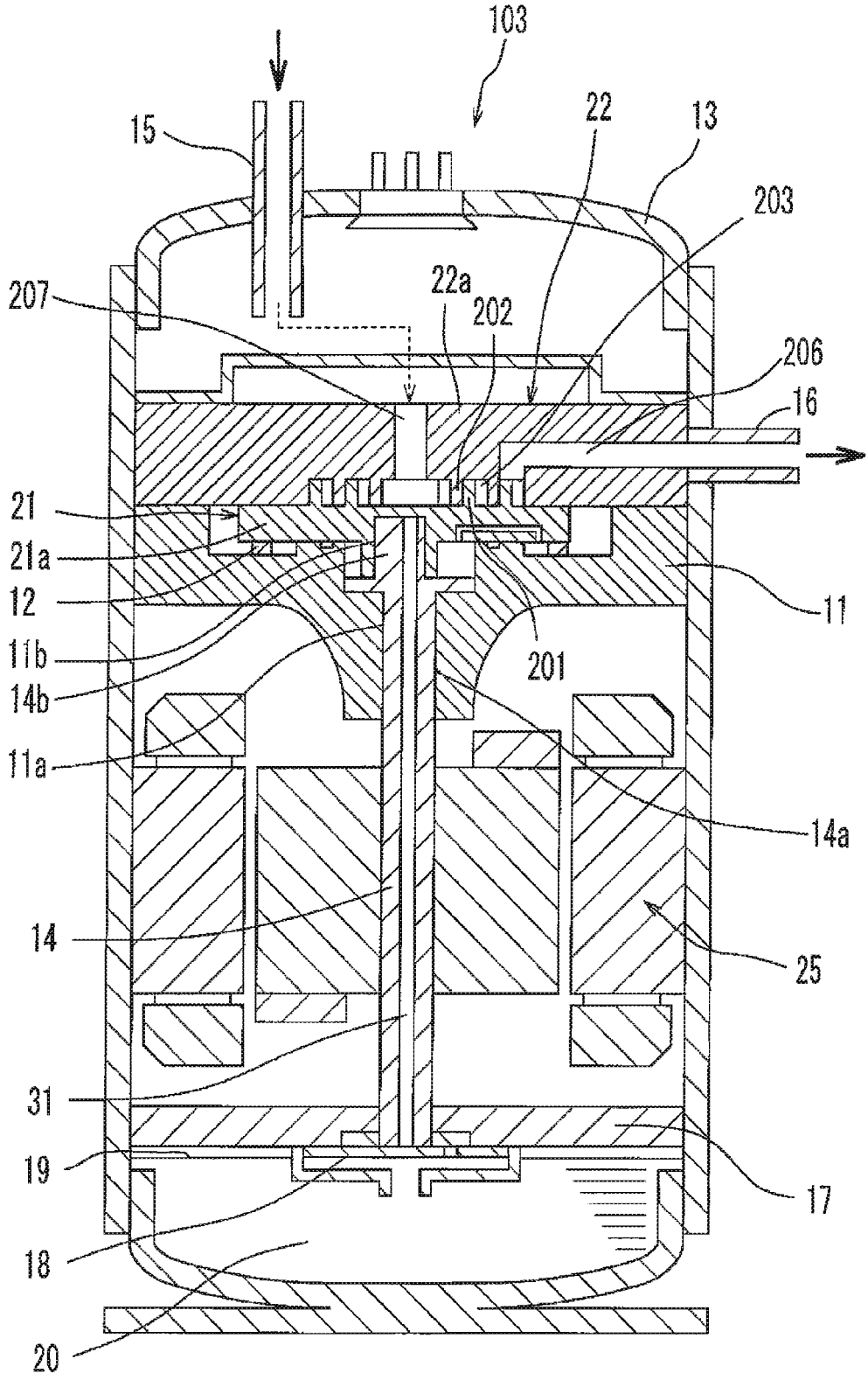
FIG. 2 is a vertical sectional view of a scroll expander according to the first embodiment of the present invention.

As illustrated in FIG. 2, the expander 103 is a scroll expander. The expander 103 is provided with a main bearing member 11, a stationary scroll 22, and an orbiting scroll 21.

The main bearing member 11 is fixed in a closed casing 13 by welding, shrink fitting or the like, and supports a main shaft portion 14*a* of a driving shaft 14. The stationary scroll 22 is fastened onto this main bearing member 11 by bolts (not shown). The stationary scroll 22 is provided with an end plate 22*a* and a scroll lap 202. The orbiting scroll 21 also is provided with an end plate 21*a* and a scroll lap 201.

Figure 3A:
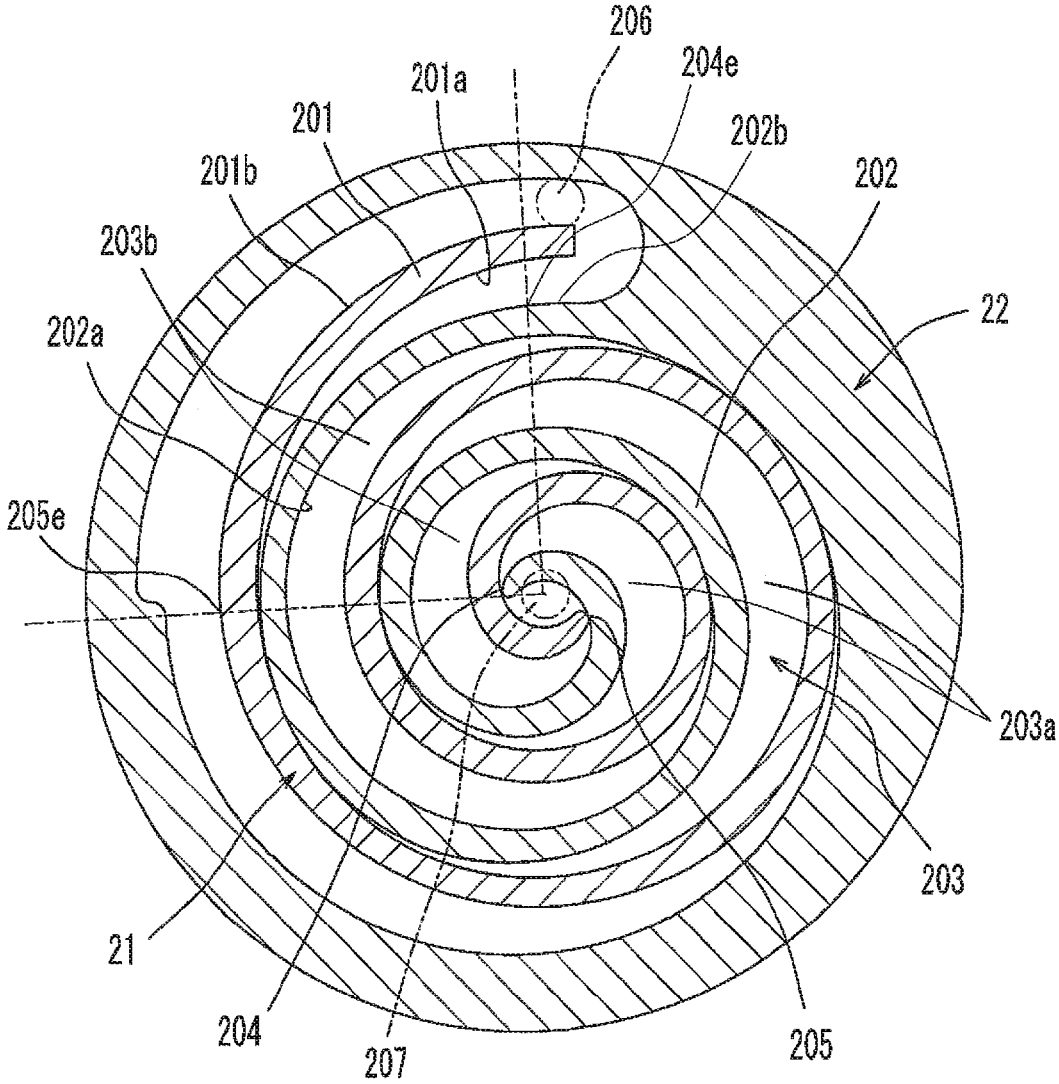
FIG. 3A is a cross-sectional view of an orbiting scroll and a stationary scroll of the scroll expander according to the first embodiment of the present invention.

The orbiting scroll 21 is sandwiched between the main bearing member 11 and the stationary scroll 22. The lap 202 of the stationary scroll 22 and the lap 201 of the orbiting scroll 21 are meshed with each other. Thereby, an expansion chamber 203 is formed between the orbiting scroll 21 and the stationary scroll 22. More specifically, as illustrated in FIG. 3A, the expansion chamber 203 is formed of two expansion chambers: an inner wall side expansion chamber 203*a* (expansion chamber A) formed between an inner wall 201*a* of the lap 201 of the orbiting scroll 21 (hereinafter referred to as an orbiting side lap 201) and an outer wall 202*b* of the lap 202 of the stationary scroll 22 (hereinafter referred to as a stationary side lap 202); and an outer wall side expansion chamber 203*b* (expansion chamber B) formed between an outer wall 201*b* of the orbiting side lap 201 and an inner wall 202*a* of the stationary side lap 202.

As illustrated in FIG. 2, a rotation-restricting mechanism such as an Oldham ring is provided between the orbiting scroll 21 and the main bearing member 11 in such a manner that the self rotation of the orbiting scroll 21 is prevented and is guided to move in a circular orbit.

An eccentric portion 14*b* is formed on the upper end of the driving shaft 14. This eccentric portion 14*b* drives the orbiting scroll 21 eccentrically to guide it to move in a circular orbit. Thereby, the expansion chamber 203 formed between the stationary scroll 22 and the orbiting scroll 21 moves from the center toward the outer circumference of the scrolls while increasing its volumetric capacity.

A suction pipe 15 for communicating the inside and outside of the closed casing 13 is provided on the top of the closed casing 13. A refrigerant comes from the suction pipe 15, flows through a refrigerant passage (as indicated by a dashed arrow) provided in the main bearing member 11 and the stationary scroll 22 and further through a suction passage 207 provided in the center part of the stationary scroll 22, and is drawn into the expansion chamber 203. The refrigerant that has been thus drawn expands as the volumetric capacity of the expansion chamber 203 changes. After expanding, the refrigerant is guided through a discharge passage 206 formed on the outer circumference side of the stationary scroll 22 and discharged through a discharge pipe 16 to the outside of the closed casing 13. A reference numeral 25 denotes a power generator.

The lower end portion of the driving shaft 14 is supported by a sub bearing member 17, and a positive displacement pump 18 is provided at the lower end of the driving shaft 14. Lubricating oil 19 is pumped up from a lubricating oil reservoir 20 by the positive displacement pump 18, and supplied through a oil supply passage 31 provided axially in the center of the driving shaft 14 so as to lubricate and cool a main bearing portion 11*a* and an eccentric bearing portion 11*b*. After that, the lubricating oil 19 passes through a lubricating oil return hole (not shown) and returns to the lubricating oil reservoir 20.

In a scroll compressor, a reed valve commonly is provided in a discharge passage in the center part of a stationary scroll. On the contrary, the scroll expander of the present embodiment does not require such a reed valve. Therefore, the suction pipe 15 and the suction passage 207 in the center part of the stationary scroll 22 may directly be connected to each other. Alternatively, a chamber for temporarily storing a refrigerant to be expanded may be provided in the closed casing 13 so that the suction pipe 15 and the suction passage 207 in the center part of the stationary scroll 22 are connected via the chamber.

In a so-called high pressure shell type scroll compressor, the closed casing thereof is filled with a compressed high-temperature and high-pressure refrigerant. The high-temperature and high-pressure refrigerant is discharged to the outside of the closed casing by way of the internal space thereof. On the other hand, in the scroll expander of the present embodiment, neither a refrigerant to be expanded nor an expanded refrigerant passes through the internal space of the closed casing 13.

FIG. 3A is a cross-sectional view of the orbiting scroll 21 and the stationary scroll 22. In the scroll expander 103 of the present embodiment, the expansion ratio of the inner wall side expansion chamber 203*a* is different from that of the outer wall side expansion chamber 203*b*.

FIG. 3A shows a moment when the inner wall side expansion chamber 203*a* and the outer wall side expansion chamber 203*b* on the innermost side shift from the suction process to the expansion process. In other words, FIG. 3A shows a moment when, in the center of the scrolls 21 and 22, the inner wall 201*a* of the orbiting side lap 201 and the outer wall 202*b* of the stationary side lap 202 come in contact with each other, and the outer wall 201*b* of the orbiting side lap 201 and the inner wall 202*a* of the stationary side lap 202 come in contact with each other. Assuming that a contact surface between the inner wall 201*a* of the orbiting side lap 201 and the outer wall 202*b* of the stationary side lap 202 is a first contact surface 204 and a contact surface between the outer wall 201*b* of the orbiting side lap 201 and the inner wall 202*a* of the stationary side lap 202 is a second contact surface 205, FIG. 3A shows a moment when the first contact surface 204 and the second contact surface 205 are newly created in the center of the orbiting scroll 21 and the stationary scroll 22.

As shown in FIG. 3A, the inner wall side expansion chamber 203*a* and the outer wall side expansion chamber 203*b* are closed at the same time. The volumetric capacity (trapped volume) of the chamber 203*a* and that of the chamber 203*b* are equal to each other when they are closed. Along with the revolution of the orbiting scroll 21, the contact surfaces 204 and 205 move from the center toward the outer circumference along the spiral shape of the laps 201 and 202, and the expansion chambers 203*a* and 203*b* move toward the outer circumference of the scrolls 21 and 22 while increasing their volumetric capacities. And eventually, the contact surfaces 204 and 205 disappear at the outermost end, so that the expansion chambers 203*a* and 203*b* are opened (communicated with the discharge passage 206).

In the present embodiment, the shape of the stationary side lap 202 is designed so that a position 204*e* where the first contact surface 204 disappears is displaced by about 90 degrees from a position 205*e* where the second contact surface 205 disappears. "The position 204*e* where the first contact surface 204 disappears" means a position on the orbiting side lap 201 (or on the stationary side lap 202) that the first contact surface 204 occupies when it disappears. In FIG. 3A, the position 204*e* is illustrated as a position on the orbiting side lap 201. Likewise, "the position 205*e* where the second contact surface 205 disappears" means a position on the orbiting side lap 201 (or on the stationary side lap 202) that the second contact surface 205 occupies when it disappears. The angular difference between the position 204*e* and the position 205*e* can be expressed as an angle between the two line segments connecting the rotation center of the shaft 14 and the positions 204*e* and 205*e* respectively.

Assuming that the direction from the outer circumference of the laps 201 and 202 toward the center thereof is "the volute tongue side of the laps", the position 205*e* where the second contact surface 205 disappears is displaced from the position 204*e* where the first contact surface 204 disappears by about 90 degrees toward the volute tongue side of the laps. In the present embodiment, the curve of the inner wall 202*a* of the lap 202 of the stationary scroll 22 becomes irregular at the position 205*e* where the second contact surface 205 disappears, so that the involute lap is terminated at the position 205*e*. In other words, an involute step is formed in this position.

Thereby, the opening timing of the outer wall side expansion chamber 203*b* lags behind that of the inner wall side expansion chamber 203*a*. As a result, the volumetric capacity (open volume) of the outer wall side expansion chamber 203*b* at the time of its opening is greater than that of the inner wall side expansion chamber 203*a* at the time of its opening.

Figure 3B:
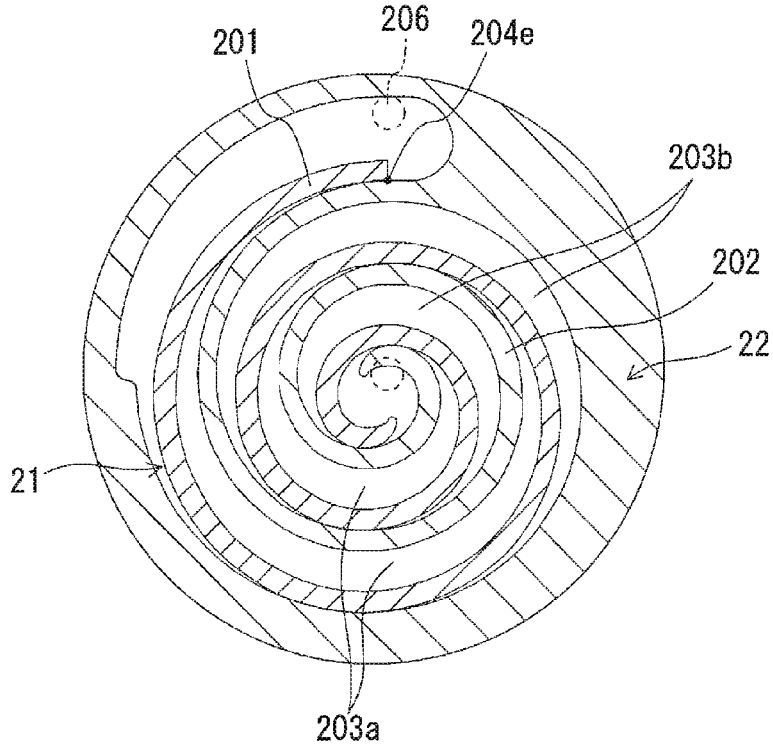
FIG. 3B is a cross-sectional view of the orbiting scroll and the stationary scroll at a moment when an inner wall side expansion chamber is opened.
Figure 3C:
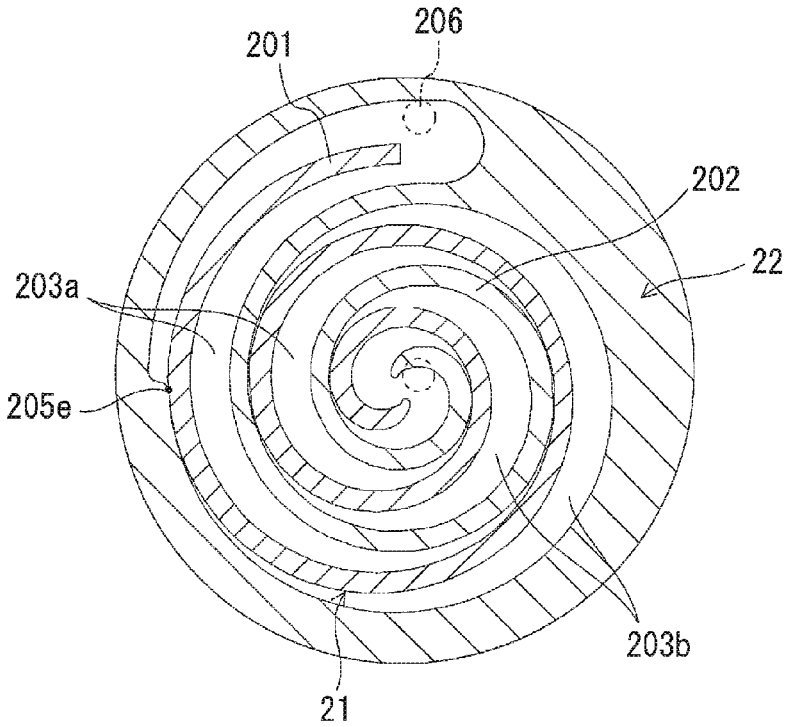
FIG. 3C is a cross-sectional view of the orbiting scroll and the stationary scroll at a moment when an outer wall side expansion chamber is opened.

Specifically, in the present embodiment, the opening timing of the outer wall side expansion chamber 203*b* lags behind that of the inner wall side expansion chamber 203*a* by about 90 degrees in terms of the rotation angle of the shaft 14. FIG. 3B shows a moment when the inner wall side expansion chamber 203*a* opens, and FIG. 3C shows a moment when the outer wall side expansion chamber 203*b* opens. The phase difference between the state of FIG. 3B and the state of FIG. 3C is about 90 degrees.

As described above, in the present embodiment, the volumetric capacity of the inner wall side expansion chamber 203*a* and that of the outer wall side expansion chamber 203*b* are equal to each other when suction is completed, and different from each other when discharge starts. As a result, the expansion ratio of the inner wall side expansion chamber 203*a* and that of the outer wall side expansion chamber 203*b* are different from each other.

The ratio between the expansion ratio of the inner wall side expansion chamber 203*a* and that of the outer wall side expansion chamber 203*b* is not limited to the example as shown in FIG. 3A. The ratio between the expansion ratios of the inner wall side expansion chamber 203*a* and the outer wall side expansion chamber 203*b* can be changed arbitrarily by setting as appropriate the position 204*e* where the first contact surface 204 disappears and the position 205*e* where the second contact surface 205 disappears. For example, the ratio can be changed as appropriate by changing the shape of the inner wall 202*a* of the lap 202 of the stationary scroll 22.

The phase difference between the opening timing of the inner wall side expansion chamber 203*a* and that of the outer wall side expansion chamber 203*b* is not limited to the difference of the present embodiment, and can be adjusted as appropriate. Taking into consideration practical aspects, it is preferable that the laps 201 and 203 be designed to have such shapes (and dimensions) that the phase difference between the opening timing of the inner wall side expansion chamber 203*a* and the opening timing of the outer wall side expansion chamber 203*b* is in a range of 30 to 150 degrees in terms of the rotation angle of the shaft 14. In other words, the volute end position (involute step) of the stationary side lap 202 should be placed 30 to 150 degrees (about 90 degrees in the present embodiment) forward from the volute end position of the orbiting side lap 201 toward the volute tongue side thereof. Thereby, the expansion ratios of the expansion chambers 203*a* and 203*b* can be set to desired values.

In the refrigeration cycle apparatus 100 (see FIG. 1), a refrigerant whose temperature and pressure are raised in the compressor 101 flows into the radiator 102, where the heat is radiated by dissipating it to the outside. Next, the refrigerant is drawn into the expander 103, where it is expanded so that the temperature and pressure thereof is lowered. This low-temperature and low-pressure refrigerant flows into the evaporator 104, receives heat from the outside, and then is drawn into the compressor 101 again. In the refrigeration cycle apparatus 100, the refrigerant repeats the cycle as described above.

The high-pressure side pressure (hereinafter referred to as just a high pressure) and the low-pressure side pressure (hereinafter referred to as just a low pressure) of the refrigeration cycle apparatus 100 are not constant but vary depending on the operation conditions. The pressure ratio (corresponding to a change in pressure in the expansion process from a high pressure to a low pressure) of the refrigerant in the expander 103 required for the cycle operation, that is, the expansion ratio expressed as (the high pressure/the low pressure), varies depending on the operation conditions.

However, if the expander 103 is a scroll expander, the expansion ratio of the expander 103 previously is set to a fixed value based on the design specification of the expansion chamber and the like. Therefore, if the expander 103 is designed to have an expansion ratio comparable to the optimum expansion ratio for a certain operation condition, under-expansion in which a refrigerant cannot be sufficiently expanded to a desired low pressure or over-expansion in which the low pressure is lowered more than it needs may occur when the operation condition is changed.

Figure 4A:
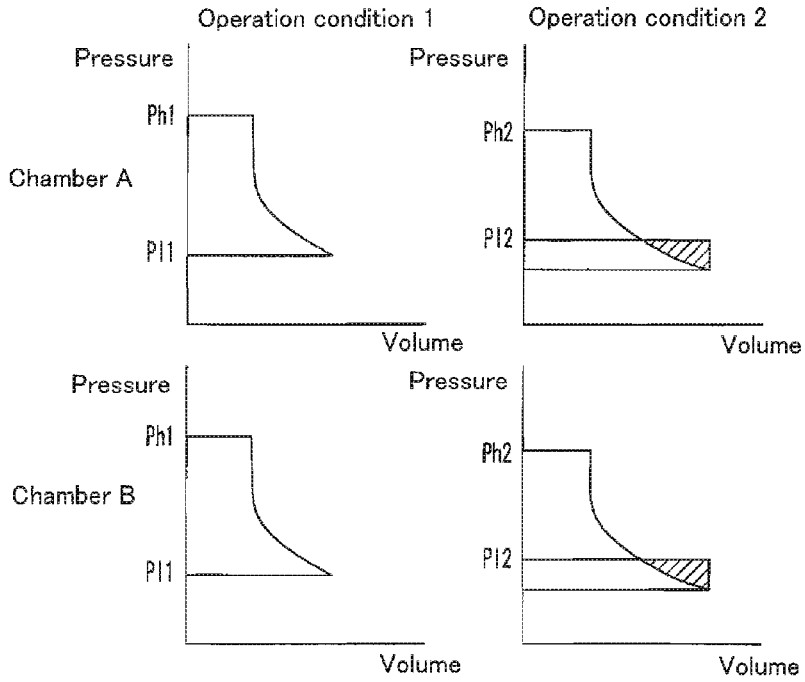
FIG. 4A is a pressure-volume diagram in an expansion process of a conventional scroll expander.
Figure 4B:
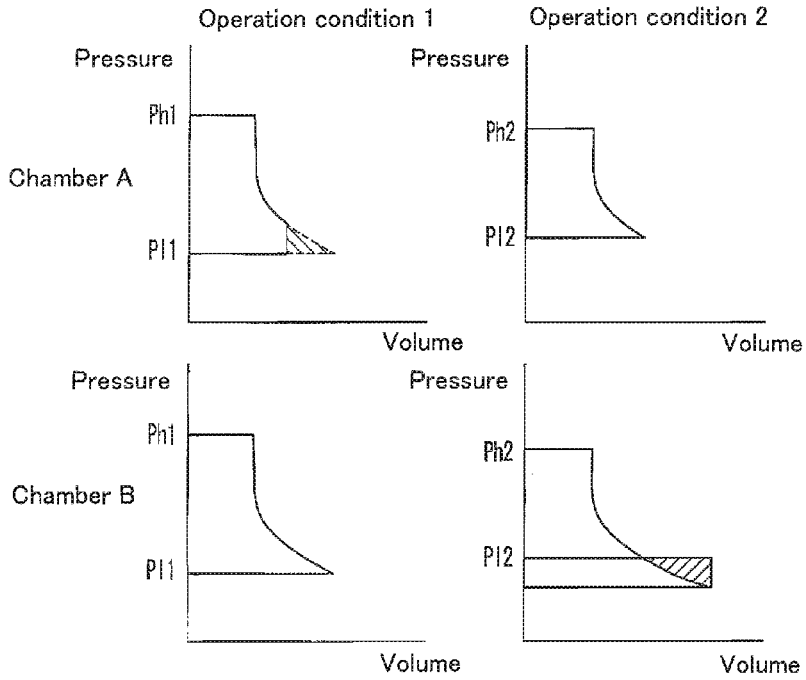
FIG. 4B is a pressure-volume diagram in an expansion process of the scroll expander according to the first embodiment of the present invention.

Here, under-expansion and overexpansion in a scroll expander will be described with reference to FIG. 4. FIGS. 4A and 4B show pressure-volume diagrams in an expansion process. FIG. 4A shows a conventional scroll expander in which the expansion ratios of the inner wall side expansion chamber and the outer wall side expansion chamber are equal to each other. On the other hand, FIG. 4B shows the scroll expander 103 of the present embodiment in which the expansion ratios of the inner wall side expansion chamber 203*a* and the outer side expansion chamber 203*b* are different from each other. In FIGS. 4A and 4B, it is assumed that the high-low pressure difference (Ph1−Pl1) under an operation condition 1 is greater than the high-low pressure difference (Ph2−Pl2) under an operation condition 2. In FIG. 4, a chamber A and a chamber B denote the inner wall side expansion chamber and the outer wall side expansion chamber, respectively.

It is assumed here that the conventional scroll expander is designed based on the operation condition 1. To be more specific, the conventional scroll expander is designed so that the expansion ratios of the inner wall side expansion chamber and the outer wall side expansion chamber are both equal to the ratio between the high pressure and the low pressure (Ph1/Pl1) under the operation condition 1, and that a refrigerant expands just enough in both the inner wall side expansion chamber and the outer wall side expansion chamber.

On the other hand, in the scroll expander 103 of the present embodiment, it is assumed that the inner wall side expansion chamber 203*a* (chamber A) is designed based on the operation condition 2 and the outer wall side expansion chamber 203*b* (chamber B) is designed based on the operation condition 1. To be more specific, the inner wall side expansion chamber 203*a* is designed to allow a refrigerant to expand just enough under the operation condition 2, and the outer wall side expansion chamber 203*b* is designed to allow the refrigerant to expand just enough under the operation condition 1.

As shown in FIG. 4A, in the conventional scroll expander, no loss occurs in the expansion process in either of the expansion chambers under the operation condition 1. However, when the operation condition changes from 1 to 2, over-expansion occurs in both the expansion chambers, thereby causing a loss in both the expansion chambers (in the diagram, the areas of the diagonally shaded portions indicate the respective amounts of loss).

As shown in FIG. 4B, in the scroll expander 103 of the present embodiment, no loss occurs in the outer wall side expansion chamber 203*b* (chamber B) under the operation condition 1. However, the refrigerant cannot expand sufficiently in the inner wall side expansion chamber 203*a* (chamber A), thereby causing a loss due to under-expansion (the area of the cross-line portion indicates the amount of loss in the diagram). On the other hand, when the operation condition changes from 1 to 2, over-expansion occurs in the outer wall side expansion chamber 203*b* (chamber B), thereby causing a loss (the area of the diagonally shaded portion indicates the amount of loss in the diagram), while no loss occurs in the inner wall side expansion chamber 203*a* (chamber A) because the refrigerant expands just enough there.

Next, a loss comparison will be made between the conventional scroll expander and the scroll expander 103 of the present embodiment based on a consideration of a change in operation conditions. Here, the occurrence ratios of the operation conditions 1 and 2 are F1 and F2, respectively (F1+F2=1.0). The amount of under-expansion loss under the operation condition 1 and the amount of over-expansion loss under the operation condition 2 are L1 and L2, respectively.

In order to consider the total amount of loss under any operation conditions, weights are assigned to the respective amounts of loss L1 and L2 based on a consideration of the occurrence ratios of these operation conditions. Then, the total amount of loss is 2×F2×L2 when the expansion ratios of the inner wall side expansion chamber and the outer wall side expansion chamber are equal to each other (in the case of the conventional scroll expander). On the other hand, when the expansion ratios of the inner wall side expansion chamber and the outer wall side expansion chamber are not equal to each other (in the case of the scroll expander 103 of the present embodiment), the total amount of loss is F1×L1+F2×L2.

Therefore, in the case of 2×F2×L2>F1×L1+F2×L2, the total amount of loss in the scroll expander 103 of the present embodiment is smaller than that of the conventional scroll expander. In view of this fact, in the refrigeration cycle apparatus 100 of the present embodiment, the scroll expander 103 is designed to satisfy 2×F2×L2>F1×L1+F2×L2.

Figure 5:
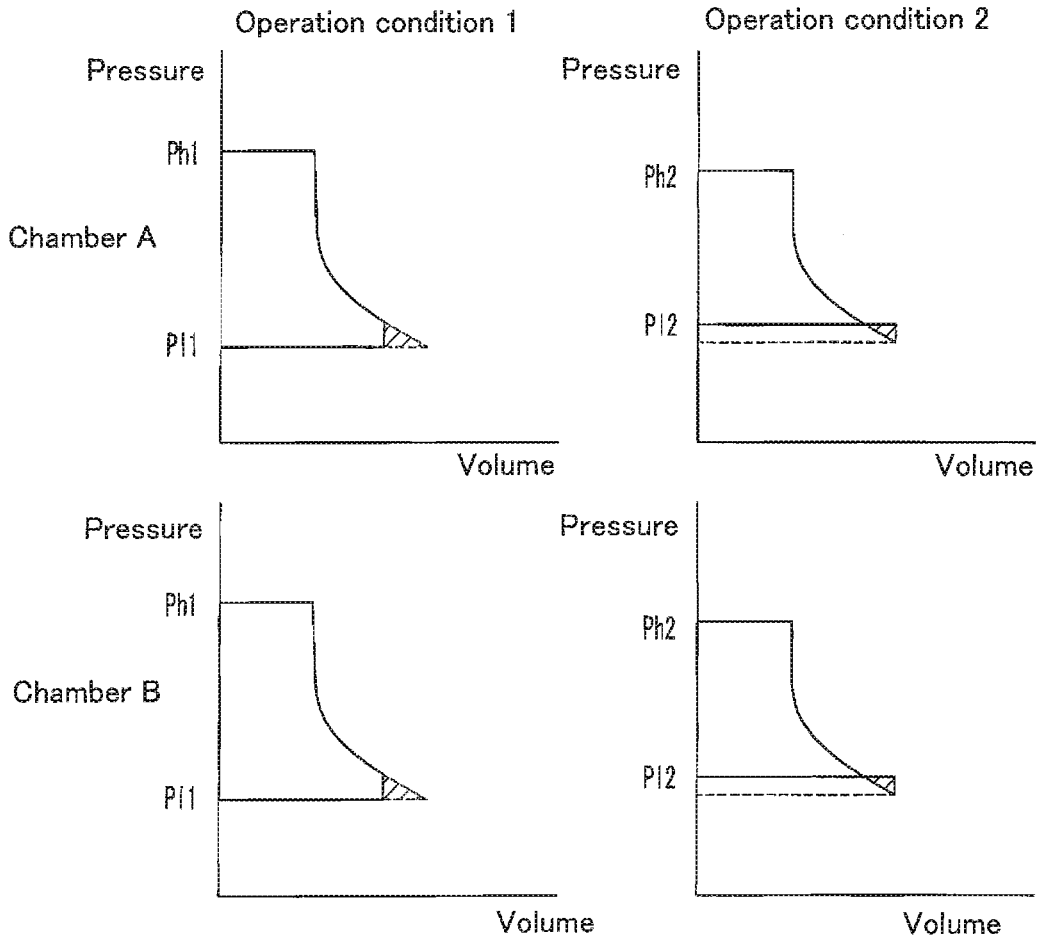
FIG. 5 is a pressure-volume diagram for an expansion process of the conventional scroll expander.

FIG. 5 is a pressure-volume diagram for an expansion process of the conventional scroll expander. It shows a case where under-expansion or over-expansion always occur in both the inner wall side expansion chamber (chamber A) and the outer wall side expansion chamber (chamber B). Here, if it is considered to reduce the total loss under any operation conditions in the conventional scroll expander, a design approach can be taken to determine the expansion ratios of the inner wall side expansion chamber and the outer wall side expansion chamber by considering the occurrence ratios of the operation conditions 1 and 2 in such a manner that a slight under-expansion occurs under the operation condition 1 and a slight over-expansion occurs under the operation condition 2 in both the expansion chambers.

However, even if such a design approach is taken, under-expansion or over-expansion always occurs in both the expansion chambers under the operation conditions 1 and 2. To make matters worse, a change in pressure caused by the under-expansion or over-expansion also causes vibrations.

In the conventional scroll expander, since both the expansion chambers serve as sources of vibrations under both the operation condition 1 and 2, the vibrations of the entire expander tend to be large. On the other hand, according to the scroll expander 103 of the present embodiment, since the expansion ratios of the inner wall side expansion chamber 203*a* and the outer wall side expansion chamber 203*b* are different from each other, one of the expansion chambers does not serve as a source of vibrations under both the operation condition 1 and 2, although the other expansion chamber serves as a source of vibrations (see FIGS. 4A and 4B). As a result, vibrations tend not to increase in the scroll expander 103 of the present embodiment even if the operation condition is changed, compared with the conventional scroll expander.

Figure 6A:
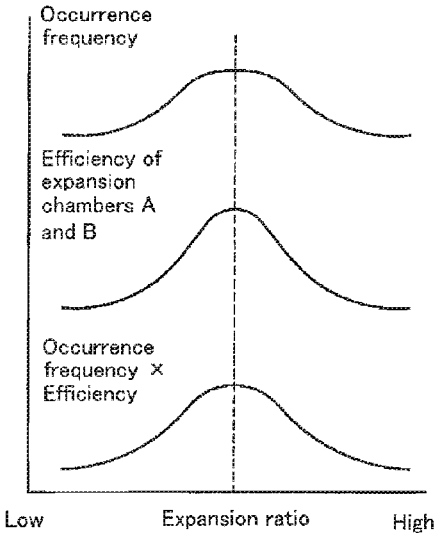
FIG. 6A is a diagram showing the characteristics of the conventional scroll expander.
Figure 6B:
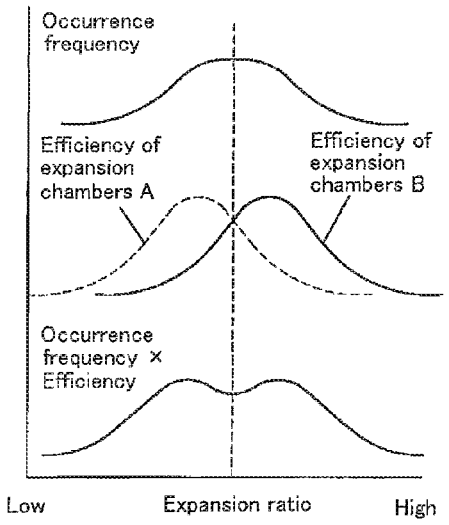
FIG. 6B is a diagram showing the characteristics of the scroll expander according to the first embodiment of the present invention.
Figure 6C:
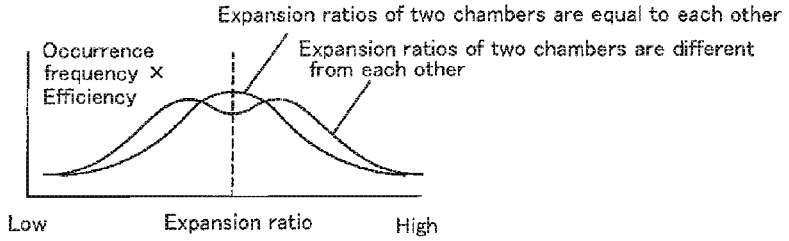
FIG. 6C is a diagram showing a comparison of the characteristics between the conventional scroll expander and the scroll expander according to the first embodiment of the present invention.

FIG. 6A shows the distribution of occurrence frequencies of expansion ratios, expansion efficiencies of respective expansion chambers, and expansion efficiencies by considering their occurrence frequencies (occurrence frequency×expansion efficiency) in a refrigeration cycle apparatus provided with the conventional scroll expander. FIG. 6B shows the distribution of occurrence frequencies of expansion ratios, expansion efficiencies of respective expansion chambers, and expansion efficiencies by considering their occurrence frequencies in the refrigeration cycle apparatus 100 provided with the scroll expander 103 of the present embodiment. In FIGS. 6A and 6B, an expansion chamber A and an expansion chamber B denote the inner wall side expansion chamber and the outer wall side expansion chamber, respectively. FIG. 6C is a diagram showing a comparison between the expansion efficiencies by considering the occurrence frequencies of the conventional scroll expander and the scroll expander 103 of the present embodiment. The occurrence frequency of a expansion ratio is intended to mean an occurrence frequency of an operation condition of a refrigeration cycle apparatus.

As shown in FIG. 6A, the expansion ratios of both the expansion chambers A and B of the conventional and typical scroll expander are determined to have the expansion ratio that occurs most frequently. This conventional scroll expander (see FIG. 6A) exhibits an excellent expansion efficiency when the expansion ratio is the most frequent one. However, if the expansion ratio of the refrigeration cycle apparatus differs from the design expansion ratio, the expansion efficiencies of both the expansion chambers A and B show a steep decline.

On the other hand, it is assumed that like the scroll expander 103 of the present embodiment, the expansion ratio of one of the expansion chambers is slightly smaller and that of the other expansion chamber is slightly greater than the expansion ratio that occurs most frequently. Then, as shown in FIG. 6B, a steep decline in the expansion efficiency can be prevented when the expansion ratio is smaller or greater than the most frequent expansion ratio, although the expansion efficiency is lower than that of the conventional scroll expander when the expansion ratio is the most frequent one.

As shown in FIG. 6C, according to the scroll expander 103 of the present embodiment, a difference between the expansion ratios of the two expansion chambers makes it possible to maintain a high expansion efficiency in a wide range of expansion ratios, compared with the conventional scroll expander in which the expansion ratios of the expansion chambers are equal to each other. This, therefore, enables the expander 103 to recover mechanical power efficiently while preventing a reduction in expansion efficiency, even if the occurrence frequency of the actual expansion ratio of the refrigeration cycle apparatus 100 differs from the design value. It is also possible to provide a refrigeration cycle apparatus that can be adapted to regions with various climates without changing the design thereof.

For example, if a refrigeration cycle apparatus is a heat pump water heater and this heat pump water heater is operated throughout the year, a number of operation conditions for summer season, winter season and intermediate season (spring and fall) exist, and the operation condition for the intermediate season has the highest occurrence frequency. The Standard of the Japan Refrigeration and Air Conditioning Industry Association (JRA4050: 2005) defines the deemed running days (heating load days) under the operation condition for each season to calculate annual power consumption of a heat pump water heater based on the actual value of power consumption measured under each operation condition. Under this standard, the deemed running days under the summer, intermediate and winter season conditions are 92 days, 152 days and 121 days, respectively.

A typical example of a conventional heat pump water heater is designed to have the highest coefficient of performance (COP) under the operation condition for intermediate season, that is, at an outdoor air temperature (dry-bulb temperature/wet-bulb temperature) of 16° C./12° C., a water temperature of 17° C., and a target water temperature to be heated of 65° C. Therefore, a conventional typical scroll expander has a disadvantage that the expansion ratios of both the expansion chambers A and B are fixed to the expansion ratio for intermediate season, thereby causing a difficulty in recovering power efficiently under the operation conditions for the seasons other than the intermediate season.

Here, as an example, a case is assumed in which the scroll expander 103 of the present embodiment is installed in a heat pump water heater using carbon dioxide as a refrigerant. The operation conditions of this heat pump water heater for the summer, winter and intermediate seasons are as follows. Summer season: high pressure of 9 MPa/low pressure of 3.5 MPa, expander inlet temperature of 35° C.; winter season: high pressure of 11.5 MPa/low pressure of 2.8 MPa, expander inlet temperature of 8° C.; and intermediate season: high pressure of 10 MPa/low pressure of 3 MPa, expander inlet temperature of 20° C. The expansion ratios in the summer, winter and intermediate seasons are 2.97, 1.95 and 2.68, respectively, based on the operation conditions for respective seasons.

Figure 7A:
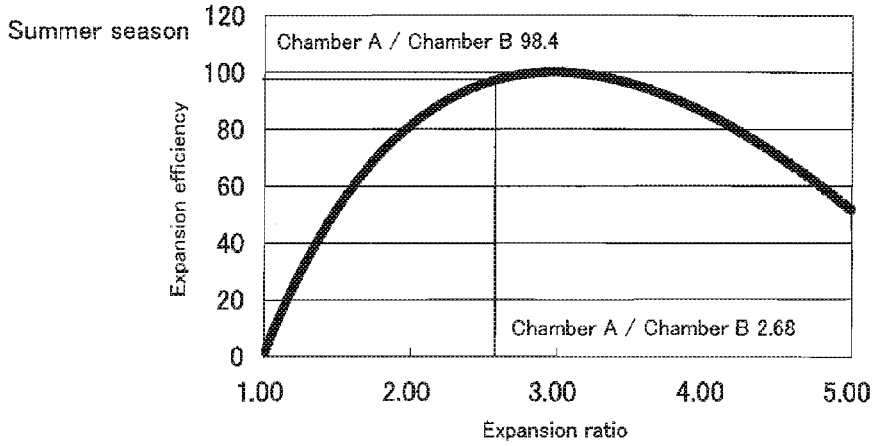
FIG. 7A is a diagram showing summer-season expansion efficiency of both the expansion chambers of the conventional scroll expander.
Figure 7B:
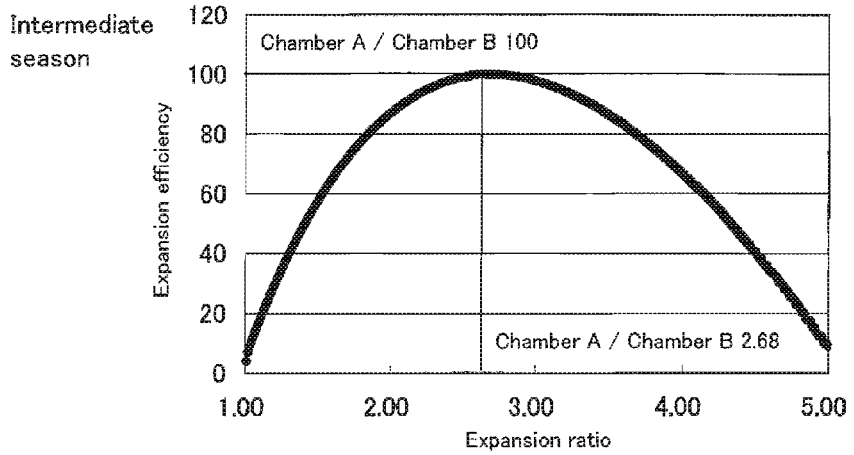
FIG. 7B is a diagram showing intermediate-season expansion efficiency of both the expansion chambers of the conventional scroll expander.
Figure 7C:
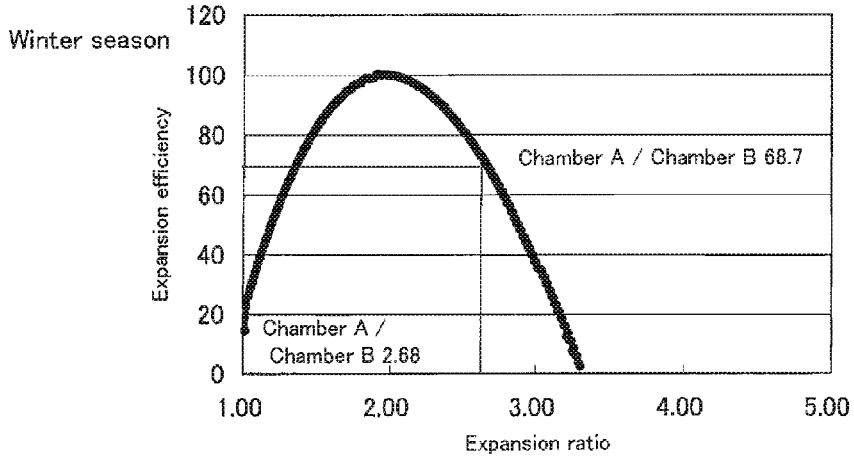
FIG. 7C is a diagram showing winter-season expansion efficiency of both the expansion chambers of the conventional scroll expander.

A conventional scroll expander is designed so that both the expansion chambers have the expansion ratio of 2.68 for the intermediate season of the highest occurrence frequency. FIG. 7A shows the summer-season expansion efficiency of both the expansion chambers of the conventional scroll expander. FIG. 7B shows the intermediate-season expansion efficiency of both the expansion chambers of the conventional scroll expander. FIG. 7C shows the winter-season expansion efficiency of both the expansion chambers of the conventional scroll expander.

As shown in FIGS. 7A to 7C, assuming that the expansion efficiency of an expansion chamber is 100.0 in each season when the chamber has an expansion ratio in which the refrigerant can expand just enough, the performance degrades due to under-expansion or over-expansion in an expansion ratio around the above ratio. When the scroll expander is designed so that the expansion ratios of the expansion chambers are both 2.68, the expansion efficiencies for the summer, intermediate and winter seasons are 98.4 (FIG. 7A), 100.0 (FIG. 7B), and 68.7 (FIG. 7C), respectively. Since there are two expansion chambers A and B, when assuming that the expansion efficiencies in the respective seasons are the average values of these two expansion chambers, the expansion efficiencies of the expander are 98.4 in the summer season, 100.0 in the intermediate season, and 68.7 in the winter season. When calculating the annual expansion efficiency of the conventional scroll expander based on the expansion efficiencies in the respective seasons and the occurrence frequencies of the respective operation conditions (heating load days of the heat pump water heater), the actual annual expansion efficiency of the conventional scroll expander is 89.2 with respect to the ideal expansion efficiency of 100.0 in which the refrigerant expands just enough constantly throughout a year.

Figure 8A:
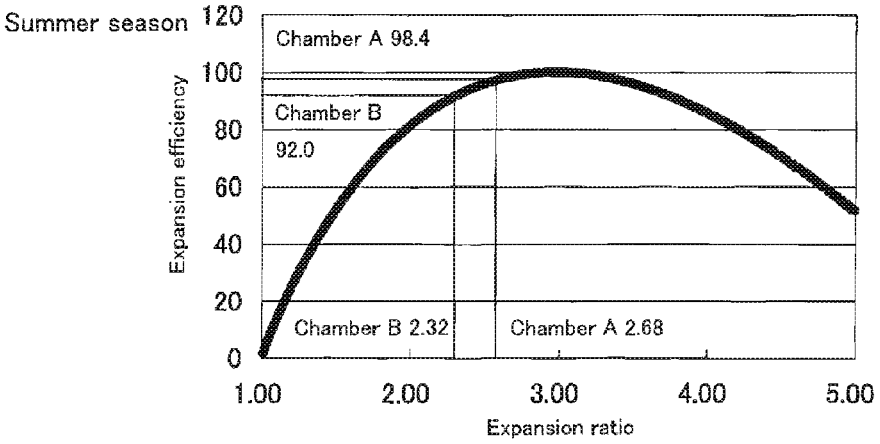
FIG. 8A is a diagram showing summer-season expansion efficiencies of both the expansion chambers of the scroll expander according to the first embodiment of the present invention.
Figure 8B:
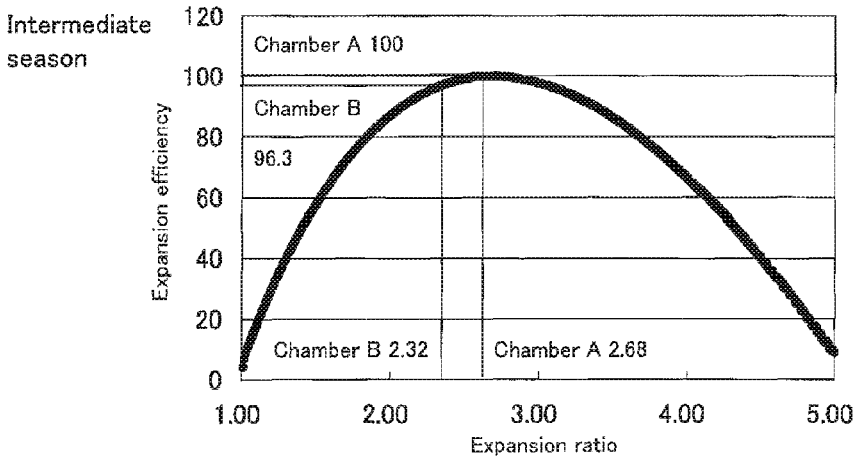
FIG. 8B is a diagram showing intermediate-season expansion efficiencies of both the expansion chambers of the scroll expander according to the first embodiment of the present invention.
Figure 8C:
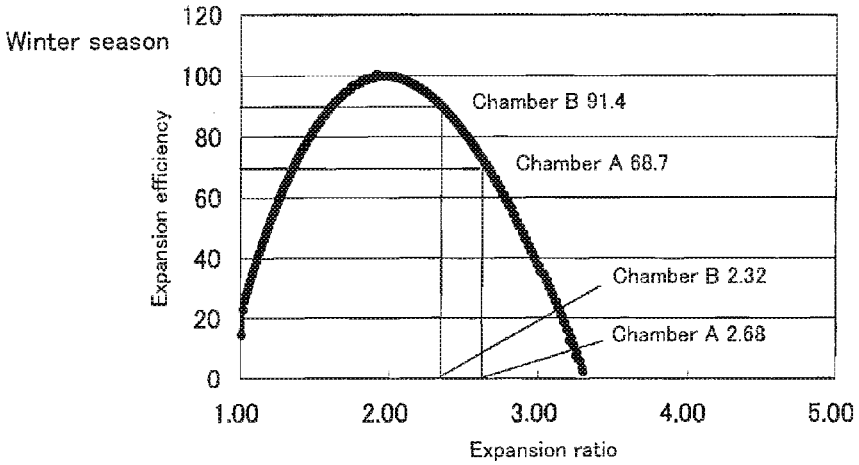
FIG. 8C is a diagram showing winter-season expansion efficiencies of both the expansion chambers of the scroll expander according to the first embodiment of the present invention.

The scroll expander 103 of the present embodiment is designed in such a manner that the expansion ratio of the chamber A is 2.68 for the intermediate season of the highest occurrence frequency and that of the chamber B is 2.32, which is a mean value between the values for the intermediate and winter seasons. FIG. 8A shows the summer-season expansion efficiencies of both the expansion chambers of the scroll expander in accordance with the first embodiment. FIG. 8B shows the intermediate-season expansion efficiencies of both the expansion chambers of the scroll expander in accordance with the first embodiment. FIG. 8C shows the winter-season expansion efficiencies of both the expansion chambers of the scroll expander in accordance with the first embodiment. As shown in FIG. 8, assuming that the expansion efficiency of an expansion chamber is 100.0 in each season when the chamber has an expansion ratio in which the refrigerant can expand just enough, the expansion efficiencies of the chamber A are 98.4 in the summer season, 100.0 in the intermediate season, and 68.7 in the winter season, whereas the expansion efficiencies of the chamber B are 92.0 in the summer season, 96.3 in the intermediate season, and 91.4 in the winter season. Assuming that the expansion efficiencies in the respective seasons are the average values of these two expansion chambers, the expansion efficiencies of the expander are 95.2 in the summer, 98.2 in the intermediate season, and 80.0 in the winter season. When calculating the annual expansion efficiency of the scroll expander 103 of the present embodiment based on the expansion efficiencies in the respective seasons and the occurrence frequencies of the respective operation conditions (heating load days of the heat pump water heater), the actual annual expansion efficiency of the scroll expander 103 of the present embodiment is 91.4 with respect to the ideal expansion efficiency of 100.0 in which the refrigerant expands just enough constantly throughout a year.

Thus, according to the scroll expander 103 of the present embodiment, the annual expansion efficiency is (91.4/89.2)×100=102.5% with respect to that of the conventional scroll expander. That is, the annual performance can be improved. The present embodiment has described a heat pump water heater and its operation conditions as an example, but the scroll expander in accordance with the present invention is not limited to this refrigeration cycle apparatus and the operation conditions. The scroll expander of the present invention also can be applied to other various refrigeration cycle apparatuses and operation conditions.

Accordingly, the scroll expander 103 of the present embodiment, in which the expansion ratios of the two expansion chambers 203*a* and 203*b* are different from each other, makes it possible to suppress a deterioration in mechanical power recovery performance caused by over-expansion or under-expansion without increasing vibrations of the expansion mechanism. The refrigeration cycle apparatus 100 of the present embodiment can maintain high efficiency under a wide range of operation conditions.

The scroll expander in accordance with the present invention is not limited to the scroll expander 103 of the first embodiment. Next, other embodiments of the scroll expander in accordance with the present invention will be described below.

(Second Embodiment)

Figure 9:
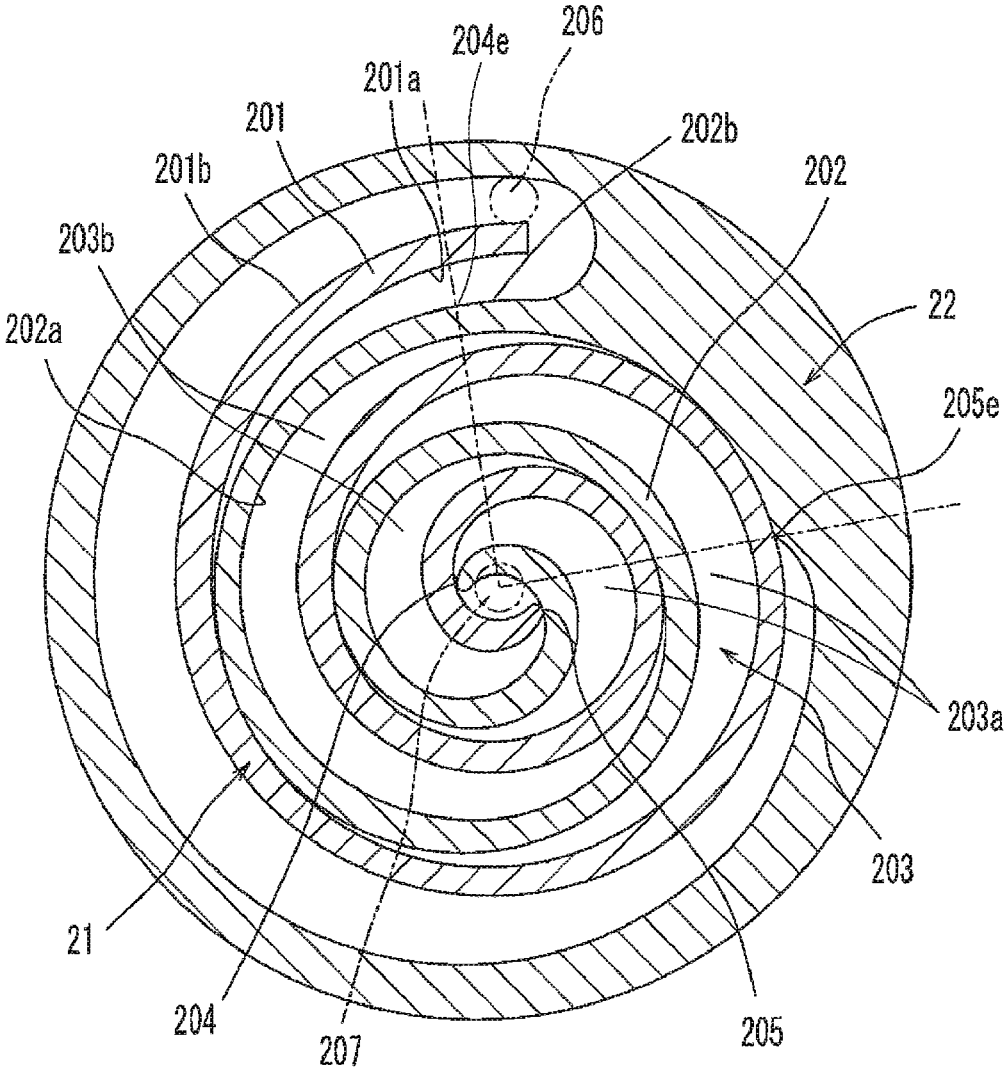
FIG. 9 is a cross-sectional view of an orbiting scroll and a stationary scroll of a scroll expander according to a second embodiment of the present invention.

FIG. 9 is a cross-sectional view of an orbiting scroll 21 and a stationary scroll 22 of a scroll expander in accordance with a second embodiment. Since the other components are the same as those of the first embodiment, overlapping description thereof is omitted.

FIG. 9 also shows a moment when the inner wall side expansion chamber 203*a* and the outer wall side expansion chamber 203*b* on the innermost side shift from the suction process to the expansion process, as is the case with FIG. 3A. Also in the present embodiment, the inner wall side expansion chamber 203*a* and the outer wall side expansion chamber 203*b* are closed at the same time. Their trapped volumes are equal to each other. The expansion chambers 203*a* and 203*b* also move toward the outer circumference of the scrolls 21 and 22 while changing their volumetric capacities. And eventually, the contact surface between the orbiting side lap 201 and the stationary side lap 202 disappears at the outermost peripheral portion.

In the present embodiment, the position 204*e* where the first contact surface 204 (a contact surface between the inner wall 201*a* of the orbiting side lap 201 and the outer wall 202*b* of the stationary side lap 202) disappears is displaced by about 270 degrees from the position 205*e* where the second contact surface 205 (a contact surface between the lap wall 201*b* of the orbiting side lap 201 and the inner wall 202*a* of the stationary side lap 202) disappears. The position 205*e* where the second contact surface 205 disappears is displaced from the position 204*e* where the first contact surface 204 disappears by about 270 degrees toward the volute tongue side of the laps. The curve of the inner wall 202*a* of the stationary side lap 202 becomes irregular at the position 205*e* where the second contact surface 205 disappears, so that the involute lap is terminated at the position 205*e*. In other words, an involute step is formed in this position 205*e*.

Thereby, the opening timing of the outer wall side expansion chamber 203*b* comes ahead of that of the inner wall side expansion chamber 203*a*. As a result, the volumetric capacity of the outer wall side expansion chamber 203*b* at the time of its opening is smaller than that of the inner wall side expansion chamber 203*a* at the time of its opening. Specifically, in the present embodiment, the opening timing of the outer wall side expansion chamber 203*b* comes ahead of that of the inner wall side expansion chamber 203*a* by about 90 degrees in terms of the rotation angle of the shaft 14.

The phase difference between the opening timing of the inner wall side expansion chamber 203*a* and that of the outer wall side expansion chamber 203*b* is not limited to that of the present embodiment, and can be adjusted as appropriate. Taking into consideration practical aspects, the volute end position (involute step) of the stationary side lap 202 can be placed 210 to 330 degrees forward from the volute end position of the orbiting side lap 201 toward the volute tongue side thereof. Thereby, the expansion ratios of the expansion chambers 203*a* and 203*b* can be set to desired values.

As described above, also in the present embodiment, the volumetric capacity of the inner wall side expansion chamber 203*a* and that of the outer wall side expansion chamber 203*b* are equal to each other when suction is completed, and different from each other when discharge starts As a result, the expansion ratio of the inner wall side expansion chamber 203*a* and that of the outer wall side expansion chamber 203*b* are different from each other.

Therefore, the present embodiment also makes it possible to suppress a deterioration in mechanical power recovery performance of the scroll expander caused by over-expansion or under-expansion thereof as well as to provide a highly efficient refrigeration cycle apparatus.

Meanwhile, in the first and second embodiments, in order to change the position where the involute lap on the outermost peripheral portion of the inner wall 202*a* of the stationary scroll 22 is terminated, the shape of the outermost peripheral portion of the lap 202 of the stationary scroll 22 is changed from the conventional shape. Specifically, a part of the outermost peripheral portion of the lap 202 of the stationary scroll 22 is cut away to form an involute step. According to the present embodiment, the step is formed on a thick portion of the lap 202 of the stationary scroll 22. Therefore, there is no significant change in the thickness of the lap 202 even if the conventional shape is changed, thereby making it possible to maintain a lap strength compatible to the conventional strength and maintain high reliability as well.

(Third Embodiment)

Figure 10:
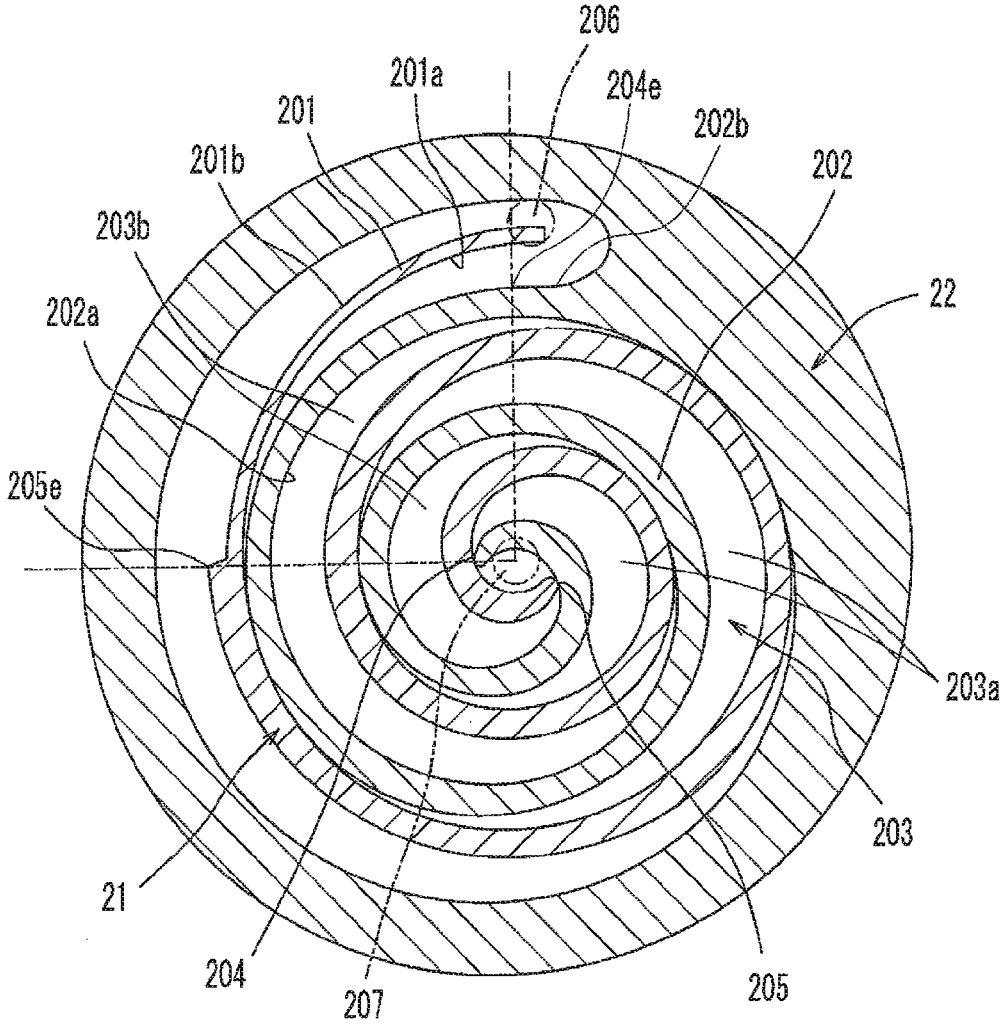
FIG. 10 is a cross-sectional view of an orbiting scroll and a stationary scroll of a scroll expander according to a third embodiment of the present invention.

FIG. 10 is a cross-sectional view of an orbiting scroll 21 and a stationary scroll 22 of a scroll expander in accordance with a third embodiment. Since the other components are the same as those of the first embodiment, overlapping description thereof is omitted.

FIG. 10 also shows a moment when the inner wall side expansion chamber 203*a* and the outer wall side expansion chamber 203*b* on the innermost side shift from the suction process to the expansion process, as is the case with FIG. 3A. Also in the present embodiment, the inner wall side expansion chamber 203*a* and the outer wall side expansion chamber 203*b* are closed at the same time. Their trapped volumes are equal to each other. The expansion chambers 203*a* and 203*b* also move toward the outer circumference of the scrolls 21 and 22 while changing their volumetric capacities. And eventually, the contact surface between the orbiting side lap 201 and the stationary side lap 202 disappears at the outermost peripheral portion.

In the present embodiment, the inner wall 202*a* of the stationary side lap 202 is formed of an involute lap until it comes close to the discharge passage 206. In other words, the inner wall 202*a* is curved smoothly and regularly until it comes close to the discharge passage 206, and there is no step thereon.

In the present embodiment, the position 204*e* where the first contact surface 204 (a contact surface between the inner wall 201*a* of the orbiting side lap 201 and the outer wall 202*b* of the stationary side lap 202) disappears is displaced by about 90 degrees from the position 205*e* where the second contact surface 205 (a contact surface between the outer wall 201*b* of the orbiting side lap 201 and the inner wall 202*a* of the stationary side lap 202) disappears. The position 205*e* where the second contact surface 205 disappears is displaced from the position 204*e* where the first contact surface 204 disappears by about 90 degrees (preferably in a range of 30 to 150 degrees) toward the volute tongue side of the laps. The curve of the outer wall 201*b* of the orbiting side lap 201 becomes irregular at the position 205*e* where the second contact surface 205 disappears, so that the involute lap is terminated at the position 205*e*. In other words, an involute step is formed in this position 205*e*.

Thereby, the opening timing of the outer wall side expansion chamber 203*b* lags behind that of the inner wall side expansion chamber 203*a*. As a result, the volumetric capacity of the outer wall side expansion chamber 203*b* at the time of its opening is greater than that of the inner wall side expansion chamber 203*a* at the time of its opening.

As described above, also in the present embodiment, the volumetric capacity of the inner wall side expansion chamber 203*a* and that of the outer wall side expansion chamber 203*b* are equal to each other when suction is completed, and different from each other when discharge starts. As a result, the expansion ratio of the inner wall side expansion chamber 203*a* and that of the outer wall side expansion chamber 203*b* are different from each other.

The present embodiment also makes it possible to suppress a deterioration in mechanical power recovery performance of the scroll expander caused by over-expansion or under-expansion thereof as well as to provide a highly efficient refrigeration cycle apparatus.

It is also possible to terminate the involute lap of the outer wall 201*b* of the orbiting side lap 201 in such a manner that the position 204*e* where the first contact surface 204 disappears is displaced by more than 180 degrees from the position 205*e* where the second contact surface 205 disappears. For example, the position 205*e* where the second contact surface 205 disappears can be displaced from the position 204*e* where the first contact surface 204 disappears by 210 to 330 degrees toward the volute tongue side of the laps. In this case, the opening timing of the outer wall side expansion chamber 203*b* is ahead of that of the inner wall side expansion chamber 203*a*. Therefore, it is possible to make the volumetric capacity of the outer wall side expansion chamber 203*b* at the time of its opening smaller than that of the inner wall side expansion chamber 203*a* at the time of its opening. Even such a configuration enables the expansion ratios of the inner wall side expansion chamber 203*a* and the outer wall side expansion chamber 203*b* to be different from each other.

In the present embodiment, in order to change the position where the involute lap on the outermost peripheral portion of the outer wall 201*b* of the orbiting side lap 201 is terminated, the shape of the outermost peripheral portion of the orbiting side lap 201 is changed from the conventional shape. The outermost peripheral portion of the orbiting side lap 201 is a relatively easily workable portion. Therefore, it is possible to set the ratio between the expansion ratios of the inner wall side expansion chamber 203*a* and the outer side expansion chamber 203*b* with a relatively simple operation.

(Fourth Embodiment)

Figure 11:
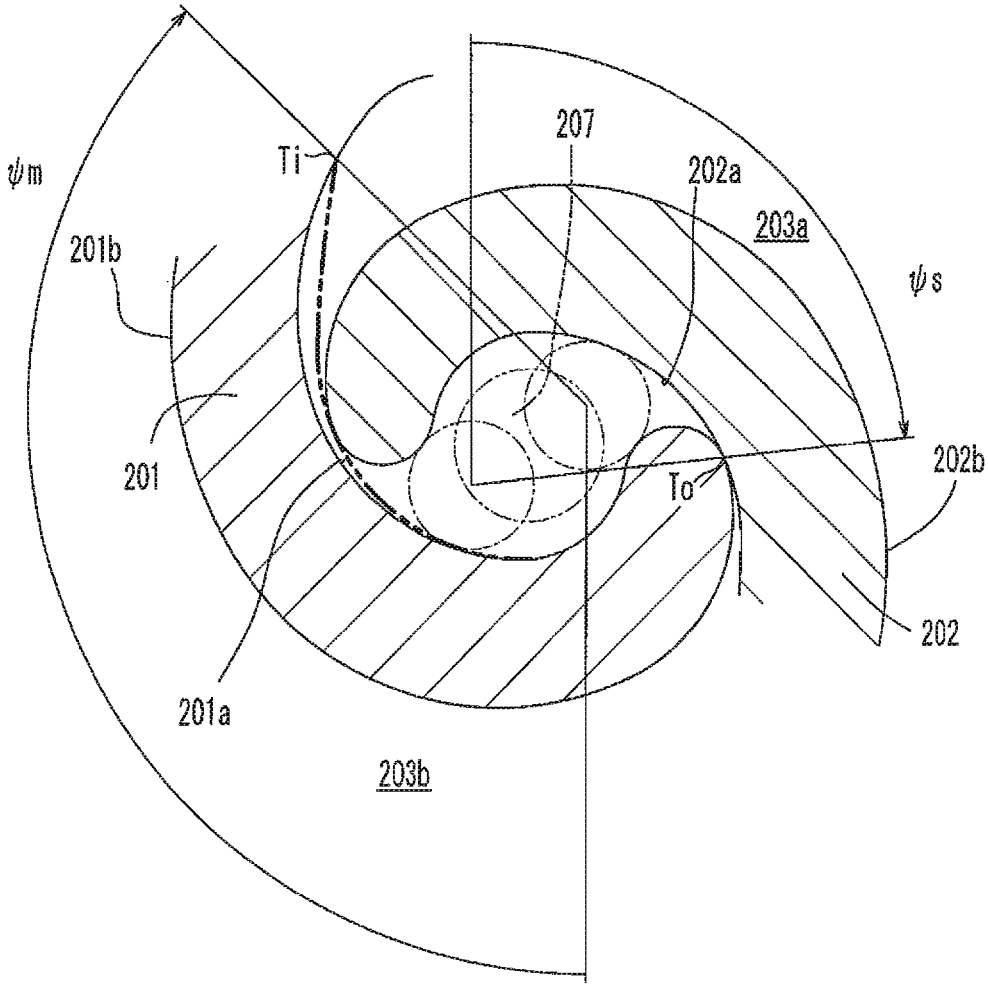
FIG. 11 is a partial cross-sectional view of an orbiting scroll and a stationary scroll of a scroll expander according to a fourth embodiment of the present invention.

As illustrated in FIG. 11, in a scroll expander in accordance with a fourth embodiment, the shape of the inner wall 201*a* of the orbiting side lap 201 is changed so that the trapped volume of the inner wall side expansion chamber 203*a* at the completion of the suction and that of the outer wall side expansion chamber 203*b* at the completion of the suction are different from each other.

In the present embodiment, the inner wall 201*a* of the orbiting side lap 201 is in the form of a circular arc or the like contoured more deeply than the normal curve of an involute lap as indicated by a chain double-dashed line in the diagram (a lap extending spirally along a predetermined involute) in the vicinity of the suction passage 207 (to be more specific, in the volute tongue portion where the involute angle is less than 180 degree), and starts following the normal curve of the involute lap from a halfway point. On the other hand, the outer wall 201*b* of the orbiting side lap 201 is formed of the involute lap throughout the entire length thereof. The volute tongue portion of the orbiting side lap 201 includes the inner wall 201*a* jutting outwardly with respect to the radial direction of the shaft 14 to deviate away from the involute curve and the outer wall 201*b* following the involute curve. In other words, the thickness of the volute tongue portion of the orbiting side lap 201 is reduced from the side of the inner wall 201*a* thereof to have a smaller thickness than that of the volute tongue portion of the stationary side lap 202. The inner wall 202*a* and the outer wall 202*b* of the stationary side lap 202 also are formed of the normal involute laps.

The inner wall side expansion chamber 203*a* and the outer wall side expansion chamber 203*b* are opened to the discharge passage 206 at the same time, and their volumetric capacities are equal to each other immediately before the opening, although not shown.

FIG. 11 shows a moment when the outer wall side expansion chamber 203*b* formed between the outer wall 201*b* of the orbiting side lap 201 and the inner wall 202*a* of the stationary side lap 202 shifts from the suction process to the expansion process. The contact surface between the outer wall 201*b* of the orbiting side lap 201 and the inner wall 202*a* of the stationary side lap 202, that is, a trapping contact point To is formed at an inner wall involute angle ψs of the stationary side lap 202 as shown in the diagram.

If the inner wall 201*a* of the orbiting side lap 201 is formed of a normal involute lap, a trapping contact point of the inner wall side expansion chamber 201*a* formed between the inner wall 201*a* of the orbiting side lap 201 and the outer wall 202*b* of the stationary side lap 202, that is, a contact point formed when the inner wall side expansion chamber 203*a* shifts from the suction process to the expansion process, is formed at a position where the inner wall involute angle of the orbiting side lap 201 is equal to the inner wall involute angle ψs of the stationary side lap 202.

However, the inner wall 201*a* of the orbiting side lap 201 is in the form of a circular arc or the like contoured more deeply than the curve of the involute lap in the vicinity of the volute tongue, and starts following the normal curve of the involute lap from a halfway point. As a result, a trapping contact point is not formed at a normal position, but the first contact point Ti is formed at an involute angle ψm where this involute lap starts, which triggers a shift from the suction process to the expansion process. The involute angle ψm shown in FIG. 11 indicates an involute angle of the inner wall 201*a* when assuming that the inner wall 201*a* follows the involute curve. This applies to the fifth embodiment illustrated in FIG. 12 likewise.

The involute angle ψm of the orbiting side lap 201 at which the first contact point Ti is formed between the inner wall 201*a* of the orbiting side lap 201 and the outer wall 202*b* of the stationary side lap 202 is greater than the involute angle ψs of the orbiting side lap at which the first contact point To is formed between the outer wall 201*b* of the orbiting side lap 201 and the inner wall 202*a* of the stationary side lap 202.

Along with the revolution of the orbiting scroll 21, the contact point To is formed first and then the contact point Ti is formed later. Therefore, the inner wall side expansion chamber 203*a* formed along with the formation of the contact point Ti has a larger trapped volume when suction is completed than the outer wall side expansion chamber 203*b* that already has been formed along with the formation of the contact point To.

In the present embodiment, the inner wall side expansion chamber 203*a* and the outer wall side expansion chamber 203*b* are opened to the discharge passage 206 at the same time, and their volumetric capacities are equal to each other when they are opened (when discharge starts). On the other hand, as described above, the trapped volume of the inner wall side expansion chamber 203*a* and that of the outer wall side expansion chamber 203*b* are different from each other when suction is completed. As a result, the expansion ratio of the inner wall side expansion chamber 203*a* and that of the outer wall side expansion chamber 203*b* are different from each other.

Therefore, the present embodiment also makes it possible to suppress a deterioration in mechanical power recovery performance of the scroll expander caused by over-expansion or under-expansion thereof as well as to provide a highly efficient refrigeration cycle apparatus.

At the moment when the contact between the orbiting side lap 201 and the stationary side lap 202 is released, a pressure difference between the discharge pressure and the pressure inside the expansion chambers 203*a* and 203*b* at the time of being opened may cause vibrations. In the present embodiment, however, the inner wall side expansion chamber 203*a* and the outer wall side expansion chamber 203*b*, which have trapped volumes different from each other, are opened at the same time. This makes it possible to suppress vibrations of the expansion mechanism, compared with the case where the expansion chambers 203*a* and 203*b* are opened alternately.

Inner wall involute angles ψm and ψs may be expressed as angles with respect to an involute angle of 0 degree, or they need not necessarily be expressed as such angles. The inner wall involute angles ψm and ψs may be expressed as involute angles with respect to a predetermined involute angle. In the present description, they are expressed in such a manner. This is because it may be difficult in some cases to define strictly a position of an involute angle=0 degree, that is, a starting position of an involute curve. A predetermined involute angle can be an involute angle defined in a range of 0 to 45 degrees, for example. As an example, an involute angle of about 20 degrees can be handled as a predetermined involute angle.

(Fifth Embodiment)

Figure 12:
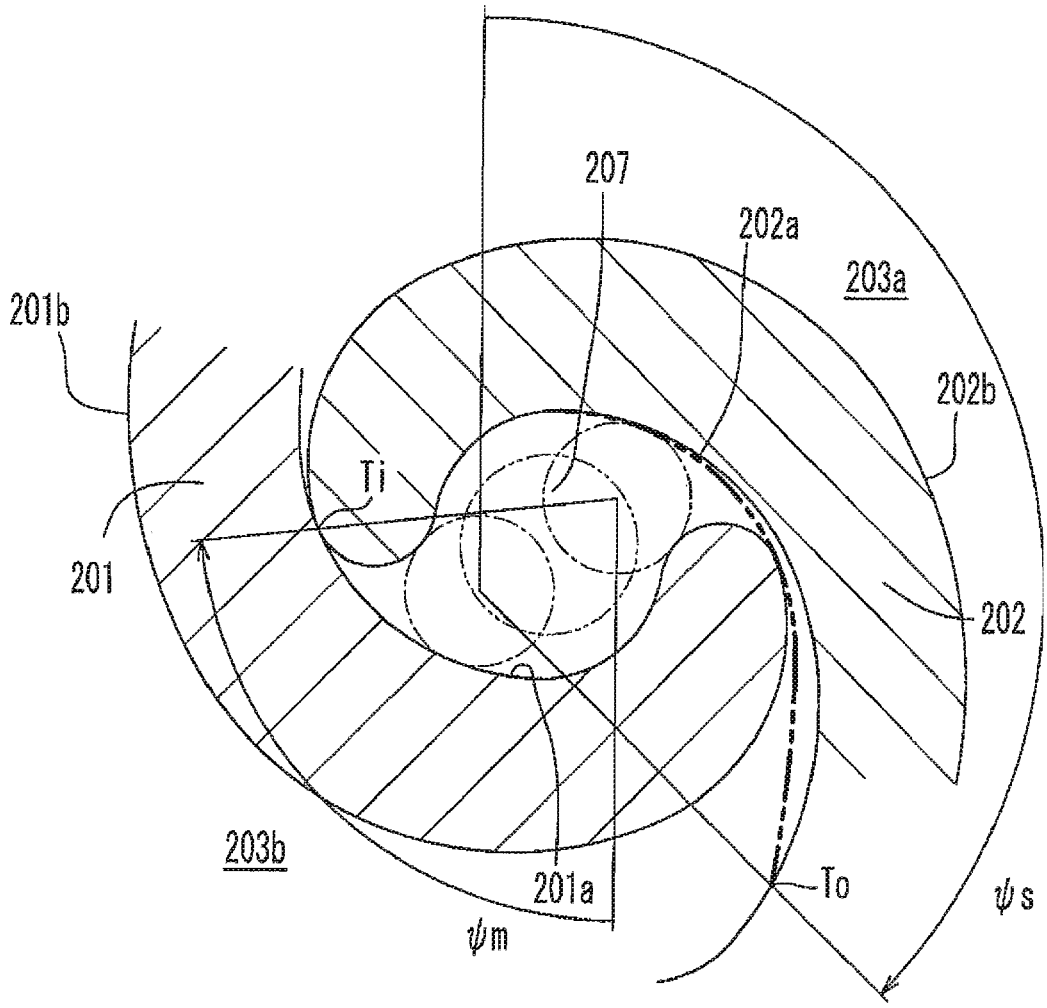
FIG. 12 is a partial cross-sectional view of an orbiting scroll and a stationary scroll of a scroll expander according to a fifth embodiment of the present invention.

As illustrated in FIG. 12, in a scroll expander in accordance with a fifth embodiment, the shape of the inner wall 202*a* of the stationary side lap 202 is changed so that the trapped volume of the inner wall side expansion chamber 203*a* at the completion of the suction and that of the outer wall side expansion chamber 203*b* at the completion of the suction are different from each other.

In the present embodiment, the inner wall 202*a* of the stationary side lap 202 is in the form of a circular arc or the like contoured more deeply than the normal curve of an involute lap as indicated by a chain double-dashed line in the diagram in the vicinity of the suction passage 207 (volute tongue portion), and starts following the normal curve of the involute lap from a halfway point. On the other hand, the outer wall 202*b* of the stationary side lap 202 is formed of the involute lap. The volute tongue portion of the stationary side lap 202 includes the inner wall 202*a* jutting outwardly with respect to the radial direction of the shaft 14 to deviate away from the involute curve and the outer wall 202*b* following the involute curve. In other words, the thickness of the volute tongue portion of the stationary side lap 202 is reduced from the side of the inner wall 202*a* thereof to have a smaller thickness than that of the volute tongue portion of the orbiting side lap 201. The inner wall 201*a* and the outer wall 201*b* of the orbiting side lap 201 are formed of the normal involute laps.

Also in the present embodiment, the inner wall side expansion chamber 203*a* and the outer wall side expansion chamber

203*b* are opened to the discharge passage 206 at the same time, and their volumetric capacities are equal to each other when they are opened, although not shown.

FIG. 12 shows a moment when the outer wall side expansion chamber 203*a* formed between the outer wall 202*b* of the stationary side lap 202 and the inner wall 201*a* of the orbiting side lap 201 shifts from the suction process to the expansion process. The contact surface between the outer wall 202*b* of the stationary side lap 202 and the inner wall 201*a* of the orbiting side lap 201, that is, a trapping contact point Ti, is formed at an inner wall involute angle ψm of the orbiting side lap 201 as shown in the diagram.

If the inner wall 202*a* of the stationary side lap 202 is formed of a normal involute lap, a trapping contact point of the outer wall side expansion chamber 203*b* formed between the inner wall 202*a* of the stationary side lap 202 and the outer wall 201*b* of the orbiting side lap 201, that is, a contact point formed when the outer wall side expansion chamber 203*b* shifts from the suction process to the expansion process, is formed at a position where the inner wall involute angle of the stationary side lap 202 is equal to the inner wall involute angle ψm of the orbiting side lap 201.

However, the inner wall 202*a* of the stationary side lap 202 is in the form of a circular arc or the like contoured more deeply than the curve of the involute lap in the vicinity of the volute tongue, and starts following the normal curve of the involute lap from a halfway point. As a result, a trapping contact point is not formed at a normal position, but the first contact point To is formed at an involute angle ψs where this involute lap starts, which triggers a shift from the suction process to the expansion process.

The involute angle ψs of the stationary side lap 202 at which the first contact point To is formed between the inner wall 202*a* of the stationary side lap 202 and the outer wall 201*b* of the orbiting side lap 201 is greater than the involute angle ψm of the orbiting side lap 201 at which the first contact point Ti is formed between the outer wall 202*b* of the stationary side lap 202 and the inner wall 201*a* of the orbiting side lap 201.

Along with the revolution of the orbiting scroll 21, the contact point Ti is formed first and then the contact point To is formed later. Therefore, the outer wall side expansion chamber 203*b* formed along with the formation of the contact point To has a larger trapped volume than the inner wall side expansion chamber 203*a* that already has been formed along with the formation of the contact point Ti.

In the present embodiment, the inner wall side expansion chamber 203*a* and the outer wall side expansion chamber 203*b* are opened to the discharge passage 206 at the same time, and their volumetric capacities are equal to each other when they are opened. On the other hand, as described above, the trapped volume of the inner wall side expansion chamber 203*a* and that of the outer wall side expansion chamber 203*b* are different from each other when suction is completed. As a result, the expansion ratio of the inner wall side expansion chamber 203*a* and that of the outer wall side expansion chamber 203*b* are different from each other.

Therefore, the present embodiment also makes it possible to suppress a deterioration in mechanical power recovery performance of the scroll expander caused by over-expansion or under-expansion thereof as well as to provide a highly efficient refrigeration cycle apparatus.

As is the case with fourth embodiment, this makes it possible to suppress vibrations of the expansion mechanism, compared with the case where the expansion chambers 203*a* and 203*b* are opened alternately.

(Sixth Embodiment)

Figure 13:
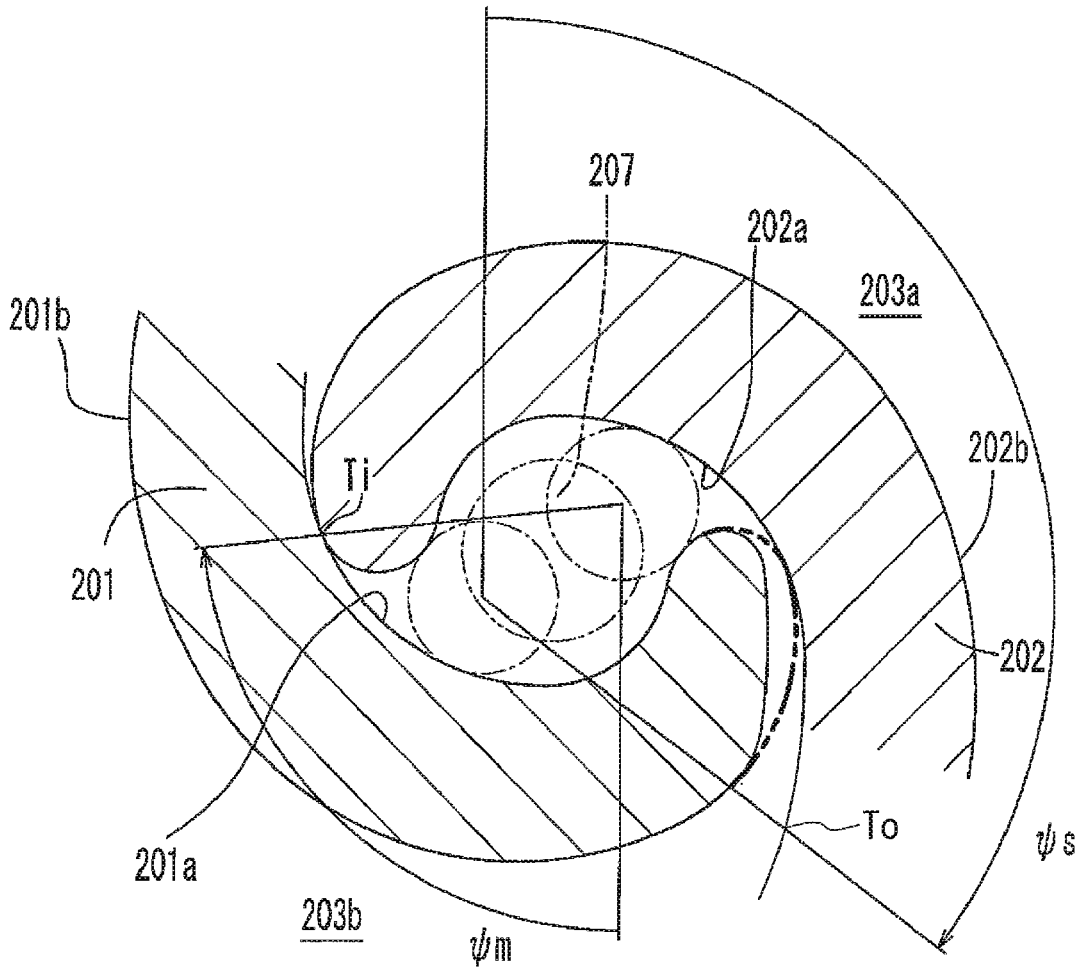
FIG. 13 is a partial cross-sectional view of an orbiting scroll and a stationary scroll of a scroll expander according to a sixth embodiment of the present invention.

Even in the embodiments other than the above-described fourth and fifth embodiments, a scroll expander can have two expansion chambers 203*a* and 203*b* having trapped volumes different from each other when suction is completed. As illustrated in FIG. 13, in a scroll expander in accordance with a sixth embodiment, the shape of the outer wall 201*b* of the orbiting side lap 201 is changed so that the trapped volume of the inner wall side expansion chamber 203*a* at the completion of the suction and that of the outer wall side expansion chamber 203*b* at the completion of the suction are different from each other.

In the present embodiment, the outer wall 201*b* of the orbiting side lap 201 is in the form of a circular arc or the like contoured more deeply than the normal curve of an involute lap as indicated by a chain double-dashed line in the diagram in the vicinity of the suction passage 207 (volute tongue portion), and starts following the normal curve of the involute lap from a halfway point. The volute tongue portion of the orbiting side lap 201 includes the outer wall 201*b* receding inwardly with respect to the radial direction of the shaft 14 to deviate away from the involute curve and the inner wall 201*a* following the involute curve.

Thereby, the inner wall involute angle ψm of the orbiting side lap 201 at which the contact point Ti is formed between the inner wall 201*a* of the orbiting side lap 201 and the outer wall 202*b* of the stationary side lap 202 is smaller than the inner wall involute angle ψs of the stationary side lap 202 at which the contact point To is formed between the outer wall 201*b* of the orbiting side lap 201 and the inner wall 202*a* of the stationary side lap 202.

As described above, also in the present embodiment, it is possible to make the trapped volume of the inner wall side expansion chamber 203*a* and that of the outer wall side expansion chamber 203*b* different from each other when suction is completed, to open these expansion chambers 203*a* and 203*b* at the same time, and to make the expansion ratios thereof different from each other.

Accordingly, the same advantageous effects can be obtained also in the present embodiment as in the fourth and fifth embodiments.

(Seventh Embodiment)

Figure 14:
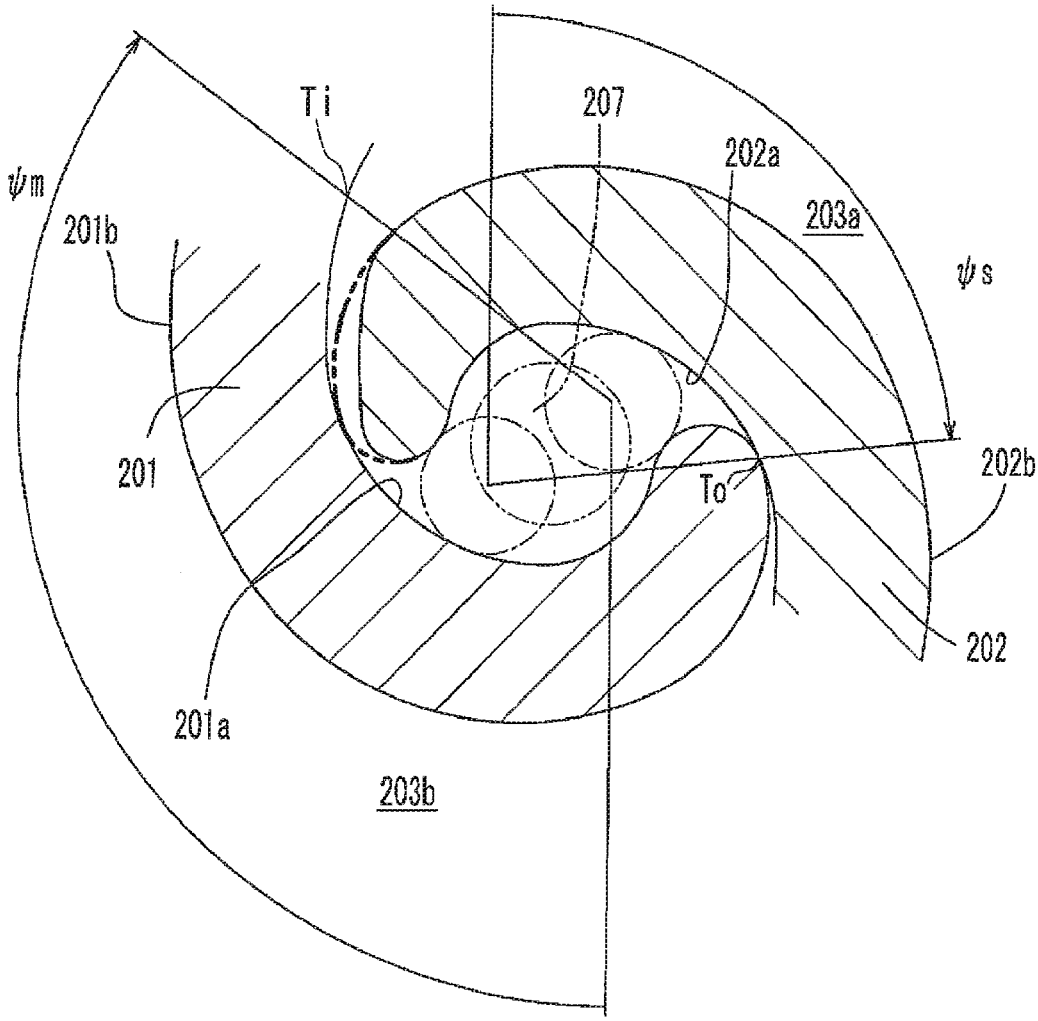
FIG. 14 is a partial cross-sectional view of an orbiting scroll and a stationary scroll of a scroll expander according to a seventh embodiment of the present invention.
Figure 15:
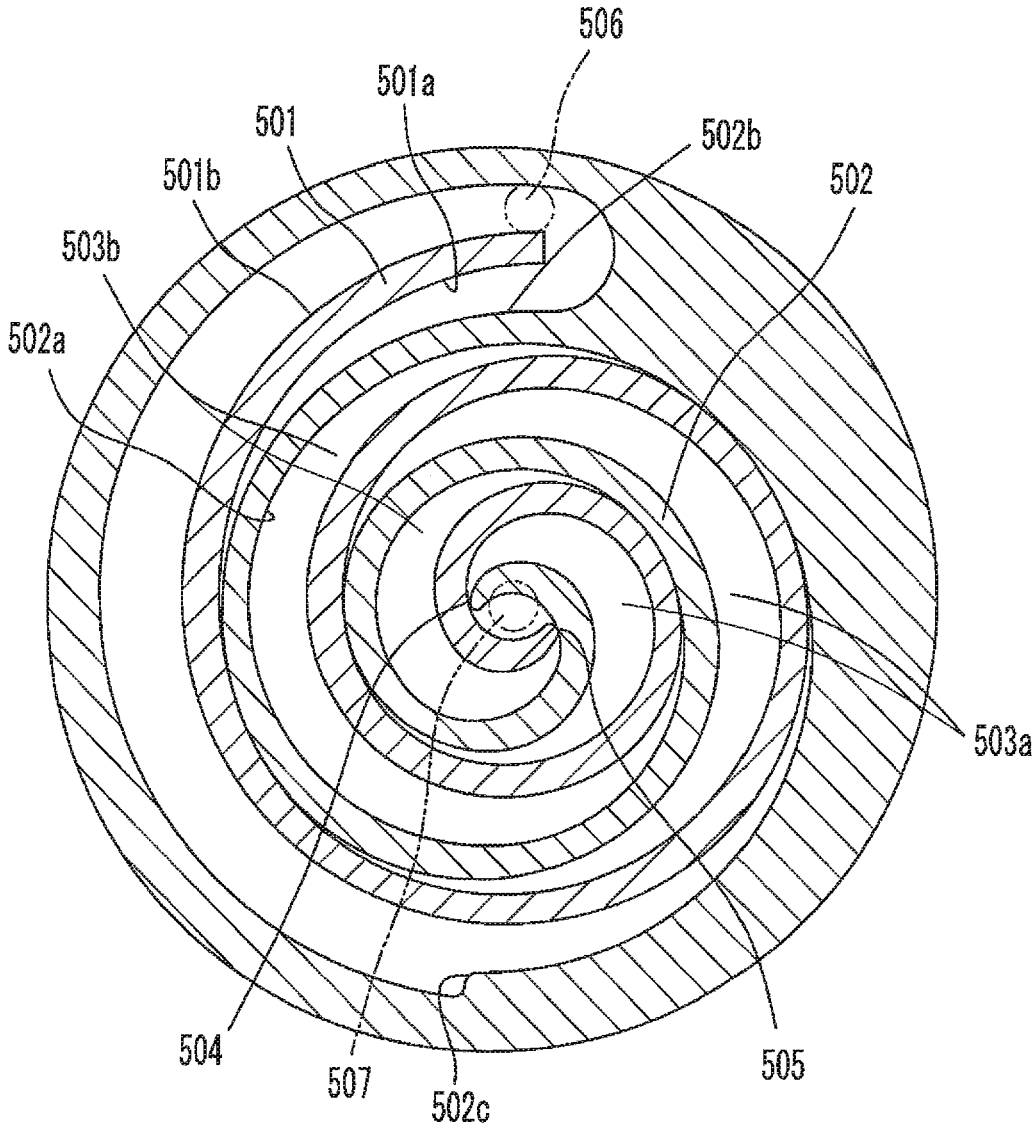
FIG. 15 is a cross-sectional view of an orbiting scroll and a stationary scroll of a conventional scroll expander.
Figure 16A:
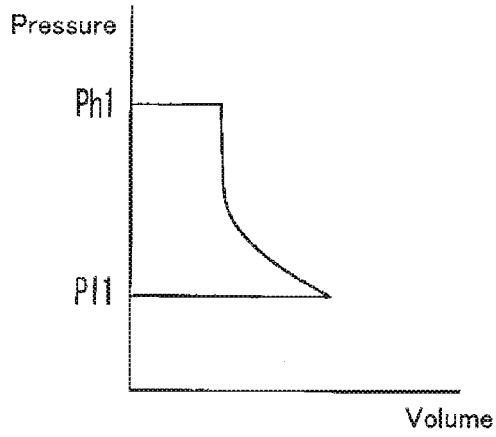
FIG. 16A is a pressure-volume diagram in an expansion process.
Figure 16B:
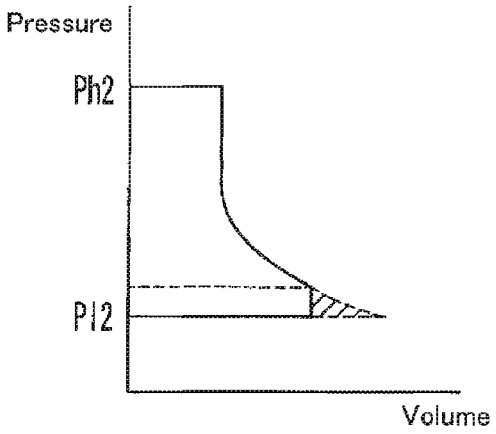
FIG. 16B is a pressure-volume diagram following FIG. 16A.
Figure 16C:
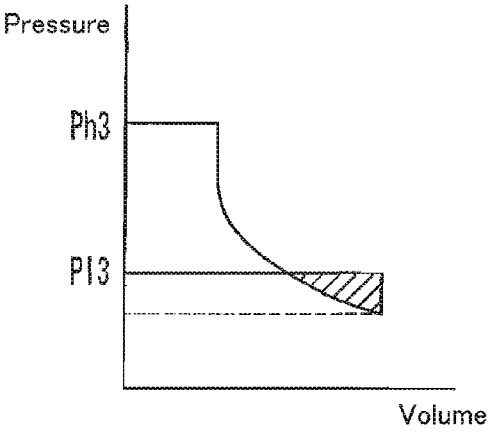
FIG. 16C is a pressure-volume diagram following FIG. 16B.

As illustrated in FIG. 14, in a scroll expander in accordance with a seventh embodiment, the shape of the outer wall 202*b* of the stationary side lap 202 is changed so that the trapped volume of the inner wall side expansion chamber 203*a* and that of the outer wall side expansion chamber 203*b* are different from each other when suction is completed.

In the present embodiment, the outer wall 202*b* of the stationary side lap 202 is in the form of a circular arc or the like contoured more deeply than the normal curve of an involute lap as indicated by a chain double-dashed line in the diagram in the vicinity of the suction passage 207 (volute tongue portion), and starts following the normal curve of the involute lap from a halfway point. The volute tongue portion of the stationary side lap 202 includes the outer wall 202*b* receding inwardly with respect to the radial direction of the shaft 14 to deviate away from the involute curve and the inner wall 202*a* following the involute curve.

Thereby, the inner wall involute angle ψm of the orbiting side lap 201 at which the contact point Ti is formed between the inner wall 201*a* of the orbiting side lap 201 and the outer wall 202*b* of the stationary side lap 202 is greater than the inner wall involute angle ψs of the stationary side lap 202 at which the contact point To is formed between the outer wall 201*b* of the orbiting side lap 201 and the inner wall 202*a* of the stationary side lap 202.

As described above, also in the present embodiment, it is possible to make the trapped volume of the inner wall side expansion chamber 203*a* and that of the outer wall side expansion chamber 203*b* different from each other when suction is completed, to open these expansion chambers 203*a* and 203*b* at the same time, and to make the expansion ratios thereof different from each other.

Accordingly, the same advantageous effects can be obtained also in the present embodiment as in the fourth and fifth embodiments.

The scroll expander of the present invention is not limited to the respective embodiments as described above, and other various modifications can be made.

The scroll expander according to the present invention may be configured so that the trapped volume of the inner wall side expansion chamber 203*a* and that of the outer wall side expansion chamber 203*b* are different from each other when suction is completed and that the volumetric capacities of these expansion chambers 203*a* and 203*b* are different from each other when they are opened.

Industrial Applicability

The present invention is useful for a scroll expander for expanding a compressible fluid to recover mechanical power energy and a refrigeration cycle apparatus including the scroll expander.

The invention claimed is:

1. A scroll expander comprising:

a first scroll having a first scroll lap; and a second scroll having a second scroll lap that is meshed with the first scroll lap, wherein the first scroll and the second scroll form an inner wall side expansion chamber on the inner wall side of the first scroll lap and an outer wall side expansion chamber on the outer wall side of the first scroll lap, the inner wall side expansion chamber and the outer wall side expansion chamber move from the center toward the outer circumference of the first and second scrolls while increasing their volumetric capacities along with a revolution of the first scroll relative to the second scroll, the first scroll lap and the second scroll lap have such shapes that an expansion ratio of the inner wall side expansion chamber and an expansion ratio of the outer wall side expansion chamber are different from each other, the volumetric capacity of the inner wall side expansion chamber and the volumetric capacity of the outer wall side expansion chamber are equal to each other when suction is completed, and different from each other when discharge starts, along with the revolution of the first scroll relative to the second scroll, a first contact surface and a second contact surface are created at the same time in the center of the first and second scrolls, the first contact surface being a contact surface between the inner wall of the first scroll lap and the outer wall of the second scroll lap, and the second contact surface being a contact surface between the outer wall of the first scroll lap and the inner wall of the second scroll lap, and an involute step is provided on the inner wall of the second scroll lap in such a manner that a second disappearance position is displaced from a first disappearance position by a predetermined angle of more than 0 degree but less than 180 degrees or a predetermined angle of more than 180 degrees but less than 360 degrees toward a volute tongue side of the second scroll lap, the first disappearance position being a position where the first contact surface disappears after moving from the center toward the outer circumference of the first and second scrolls, and the second disappearance position being a position where the second contact surface disappears after moving from the center toward the outer circumference of the first and second scrolls.

2. The scroll expander according to claim 1, wherein the first scroll lap and the second scroll lap have shapes such that a phase difference between a timing at which the inner wall side expansion chamber opens and a timing at which the outer wall side expansion chamber opens is in a range of 30 to 150 degrees in terms of the rotation angle of a shaft.

3. A refrigeration cycle apparatus comprising: a compressor; a radiator; an expander; and an evaporator that are connected successively in series by pipes, wherein the expander comprises the scroll expander according to claim 1.

* * * * *